US011807341B2

(12) United States Patent
Ritchel et al.

(10) Patent No.: US 11,807,341 B2
(45) **Date of Patent: *Nov. 7, 2023**

(54) REINFORCED ARTICULATED TOP

(71) Applicant: Dowco, Inc., Manitowoc,, WI (US)

(72) Inventors: Ryan Ritchel, Lebanon, MO (US); David Baird, Marshfield, MO (US); Bhavana Singh, Lebanon, MO (US); Randy Michael, Lebanon, MO (US); Caleb Stith, Lebanon, MO (US); Cory Halsted, Lebanon, MO (US); Mark McSorley, Lebanon, MO (US); Ron Raby, Springfield, MS (US); Gary Gasteiger, New Haven, IN (US)

(73) Assignee: Dowco, Inc., Manitowoc, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/051,920

(22) Filed: Nov. 2, 2022

(65) Prior Publication Data

US 2023/0192240 A1 Jun. 22, 2023

Related U.S. Application Data

(63) Continuation of application No. 17/808,473, filed on Jun. 23, 2022, now Pat. No. 11,518,480, which is a (Continued)

(51) Int. Cl.
*B63B 17/02* (2006.01)
*B63B 17/00* (2006.01)

(52) U.S. Cl.
CPC ..... *B63B 17/02* (2013.01); *B63B 17/00* (2013.01)

(58) Field of Classification Search
CPC ..... B63B 17/00; B63B 17/02
(Continued)

(56) References Cited

U.S. PATENT DOCUMENTS

RE5,094 E 10/1872 Mathewson
646,347 A 3/1900 Betty
(Continued)

FOREIGN PATENT DOCUMENTS

DE 202005009471 6/2020
EP 2727494 5/2014
(Continued)

OTHER PUBLICATIONS

"Detrin® Acetal Resin," DuPont, https://web.archive.org/web/*/http://www.dupont.com/products-and-services/plastics-polymers-resins/thermoplastics/brands/detrin-acetal-resin.html. Obtained from the internet archive 2013.
(Continued)

*Primary Examiner* — Lars A Olson
(74) *Attorney, Agent, or Firm* — Shane Delsman; Godfrey & Kahn, S.C.

(57) ABSTRACT

An articulating top having a frame, a cover attached to the frame and a mounting bracket to attach the frame to a vehicle can be moved between a deployed position to provide shelter to an area below the top and a stowed position. The frame having main and secondary frame members in addition to one or more struts between a frame member and the vehicle to provide additional support to the frame such that the top can be used while the vehicle is in motion or in windy conditions. The top may also use one or more braces.

7 Claims, 40 Drawing Sheets

Related U.S. Application Data continuation of application No. 17/482,358, filed on Sep. 22, 2021, now Pat. No. 11,472,512, which is a continuation-in-part of application No. 17/302,963, filed on May 17, 2021, which is a continuation of application No. 16/865,735, filed on May 4, 2020, now Pat. No. 11,046,394.

(58) Field of Classification Search
USPC ..... 114/361
See application file for complete search history.

(56) References Cited

U.S. PATENT DOCUMENTS 1,039,986 A 10/1912 Merritt
1,289,265 A 12/1918 Richard et al.
1,473,436 A 11/1923 Leopold
1,541,674 A 6/1925 Weer
1,639,009 A 8/1927 Bingley
1,972,246 A 9/1934 Bauer
2,145,307 A 1/1939 Hunt
2,210,147 A 8/1940 Griffith
2,895,757 A 7/1955 Kaspar
2,817,345 A 12/1957 Woodruff, Sr.
2,818,291 A 12/1957 Corns
3,187,373 A 6/1965 Fisher
3,316,012 A 4/1967 Thier
3,354,892 A 11/1967 Frieder
3,399,687 A 9/1968 Frieder
3,489,452 A 1/1970 Plante
3,525,448 A 8/1970 Bauer
3,613,151 A 10/1971 Anderson et al.
3,653,079 A 4/1972 Bourgraf et al.
3,801,208 A 4/1974 Bourgraf et al.
3,930,645 A 1/1976 Anderson
3,955,240 A 5/1976 Schuh et al.
3,955,732 A 5/1976 Boschen
4,106,145 A 8/1978 Gillen et al.
4,111,217 A 9/1978 Victor
4,139,245 A 2/1979 McCloskey
4,356,593 A 11/1982 Heininger et al.
4,577,986 A 3/1986 Wang
4,660,791 A 4/1987 Lisak
4,683,900 A 8/1987 Carmichael
4,804,220 A 2/1989 Rosheim
4,928,916 A 5/1990 Molloy
5,058,239 A 10/1991 Lee
5,058,829 A 10/1991 Bentley
5,251,359 A 10/1993 Finkl
5,271,423 A 12/1993 Eychaner
5,303,667 A 4/1994 Zirkelbach et al.
5,353,892 A 10/1994 Lu
5,380,113 A 1/1995 Boehm
5,413,063 A 5/1995 King
5,440,948 A 8/1995 Cheng
5,441,066 A 8/1995 Harris
5,457,828 A 10/1995 Huang
5,472,301 A 12/1995 Wallen
5,520,139 A 5/1996 King et al.
5,539,957 A 7/1996 Schmidt
5,577,415 A 11/1996 Reasoner
5,611,552 A 3/1997 Miles et al.
5,645,309 A 7/1997 Graf
5,681,045 A 10/1997 Liao
5,685,660 A 11/1997 Liao
5,697,320 A 12/1997 Murray
5,706,752 A 1/1998 Menne, Jr. et al.
5,730,449 A 3/1998 Miles
5,740,998 A 4/1998 Lindsay et al.
5,766,081 A 6/1998 Desmarais
5,803,104 A 9/1998 Pollen
5,938,223 A 8/1999 Kotlier
5,941,011 A 8/1999 Baker
6,018,846 A 2/2000 Huang
6,042,066 A 3/2000 Maharg et al.
6,082,753 A 7/2000 Kotlier
6,135,487 A 10/2000 Flannery et al.
6,135,668 A 10/2000 Lin
6,151,756 A 11/2000 Czipri
6,152,434 A 11/2000 Gluck
D437,210 S 2/2001 Borotto et al.
6,209,477 B1 4/2001 Biedenweg
6,223,366 B1 5/2001 Cheng
6,223,680 B1 5/2001 Frink et al.
6,238,125 B1 5/2001 Lin
6,257,261 B1 7/2001 Johnson
D451,364 S 12/2001 Borotto et al.
D451,371 S 12/2001 Borotto et al.
6,353,969 B1 3/2002 LeMole
6,354,758 B1 3/2002 Chaulk
6,393,664 B1 5/2002 Habegger et al.
6,467,986 B2 10/2002 Feng
6,533,489 B1 3/2003 Zheng
6,536,726 B1 3/2003 Tull
6,565,069 B2 5/2003 Morris
6,594,860 B2 7/2003 Czipri
6,666,163 B2 12/2003 Pastor et al.
6,672,241 B2 1/2004 Warfel et al.
6,676,329 B2 1/2004 Mandon et al.
6,711,783 B2 3/2004 LeMole
6,722,812 B1 4/2004 Carletti et al.
6,763,650 B1 7/2004 Snow
6,851,652 B1 2/2005 Huang
6,907,642 B1 6/2005 Czipri
6,928,766 B1 8/2005 Goebel et al.
6,944,913 B2 9/2005 Henderson et al.
6,964,425 B2 11/2005 Turner
6,968,800 B1 11/2005 Becht
6,983,716 B1 1/2006 Ankney et al.
7,003,849 B2 2/2006 Cohen et al.
7,007,344 B2 3/2006 Lee
7,029,197 B2 4/2006 Lin et al.
7,063,035 B2 6/2006 Belcher
7,077,906 B2 7/2006 Colombo et al.
7,100,739 B2 9/2006 Parker et al.
7,131,166 B2 11/2006 Cohen et al.
7,159,530 B1 1/2007 Shearer et al.
7,162,968 B2 1/2007 Thompson
7,204,466 B2 4/2007 Hsieh
7,210,726 B2 5/2007 Merlot, Jr
7,210,871 B2 5/2007 Slatter
7,254,869 B2 8/2007 You
7,290,472 B2 11/2007 Gass et al.
7,302,907 B2 12/2007 Carlton
7,309,054 B2 12/2007 Slatter et al.
7,325,856 B2 2/2008 Merlot, Jr. et al.
7,331,304 B2 2/2008 Erskine et al.
7,334,956 B2 2/2008 Taylor
7,340,801 B2 3/2008 Yamaguchi
7,380,311 B2 6/2008 Chen
7,389,737 B1 6/2008 Schwindaman
7,413,370 B2 8/2008 Burnley
7,438,015 B1 10/2008 Schwindaman
7,458,333 B2 12/2008 Yang
7,461,995 B2 12/2008 Burnley
7,481,438 B2 1/2009 Hernandez
7,490,574 B2 2/2009 Shearer et al.
7,523,906 B2 4/2009 Bennett
7,536,971 B1 5/2009 Fry
7,571,691 B2 8/2009 Russikoff
7,614,097 B1 11/2009 Cheng
7,634,969 B2 12/2009 Neunzert et al.
7,661,747 B2 2/2010 Erskine et al.
7,674,063 B2 3/2010 Jan et al.
7,721,391 B2 5/2010 Bukovitz et al.
7,726,618 B2 6/2010 Pedemonte
7,735,431 B2 6/2010 Neunzert et al.
7,753,612 B2 7/2010 Bouru et al.
7,774,901 B1 8/2010 Huang
7,895,964 B2 3/2011 Russikoff
7,921,513 B2 4/2011 Burnley
7,921,797 B2 4/2011 James
7,950,342 B2 5/2011 Russikoff
7,984,531 B2 7/2011 Moore

(56) References Cited

U.S. PATENT DOCUMENTS

| | | | |
|---|---|---|---|
| 8,006,345 | B1 | 8/2011 | Bryce |
| 8,007,196 | B2 | 8/2011 | Whitling et al. |
| 8,052,110 | B2 | 11/2011 | Wang |
| 8,069,533 | B2 | 12/2011 | Yu et al. |
| 8,087,374 | B2 | 1/2012 | Porter |
| 8,152,118 | B2 | 4/2012 | Melic |
| 8,297,208 | B2 | 10/2012 | Hoffman |
| 8,359,709 | B2 | 1/2013 | Van Gennep |
| 8,425,345 | B2 | 4/2013 | Wall, Jr. et al. |
| 8,590,849 | B2 | 11/2013 | Melic |
| 8,616,511 | B2 | 12/2013 | James |
| 8,635,743 | B2 | 1/2014 | Smith et al. |
| 8,708,100 | B2 | 4/2014 | Schwoerer |
| 8,752,498 | B1 | 6/2014 | Schwindaman et al. |
| 8,857,366 | B2 | 10/2014 | Russikoff |
| 8,876,646 | B2 | 11/2014 | Gasser |
| 8,967,710 | B2 | 3/2015 | Hu et al. |
| 8,973,866 | B2 | 3/2015 | Ribarov et al. |
| 8,973,899 | B2 | 3/2015 | Buckingham et al. |
| 9,016,773 | B2 | 4/2015 | Tanner et al. |
| 9,032,983 | B2 | 5/2015 | Jin |
| 9,096,291 | B2 | 8/2015 | Perosino et al. |
| 9,139,258 | B2 | 9/2015 | Russikoff |
| 9,169,680 | B2 | 10/2015 | Kim et al. |
| 9,365,264 | B2 | 6/2016 | Perosino et al. |
| 9,371,108 | B2 | 6/2016 | Bettin |
| 9,488,216 | B2 | 11/2016 | Godiot et al. |
| 9,580,149 | B2 | 2/2017 | Poppell et al. |
| 9,604,702 | B2 | 3/2017 | Hough et al. |
| 9,718,517 | B2 | 8/2017 | Zirkelbach et al. |
| 9,752,364 | B2 | 9/2017 | James |
| 9,783,266 | B2 | 10/2017 | Hough |
| 9,783,267 | B1 | 10/2017 | Alexander et al. |
| 9,815,525 | B2 | 11/2017 | Hough |
| 9,849,939 | B2 | 12/2017 | Hough et al. |
| 9,909,617 | B1 | 3/2018 | Prey |
| 10,167,894 | B2 | 1/2019 | James |
| 10,513,314 | B2 | 12/2019 | Parniske et al. |
| 11,046,394 | B1 | 6/2021 | Ritchel et al. |
| 11,472,512 | B1 * | 10/2022 | Ritchel ..... B63B 17/02 |
| 11,518,480 | B1 * | 12/2022 | Ritchel ..... B63B 17/02 |
| 2004/0036222 | A1 | 2/2004 | Chou |
| 2006/0016047 | A1 | 1/2006 | Blackman et al. |
| 2007/0287614 | A1 | 12/2007 | Fuller |
| 2008/0066794 | A1 | 3/2008 | Durfee |
| 2008/0193205 | A1 | 8/2008 | Peng et al. |
| 2009/0057505 | A1 | 3/2009 | Chen |
| 2009/0119877 | A1 | 5/2009 | Garrett |
| 2009/0194016 | A1 | 8/2009 | Murphy |
| 2011/0272923 | A1 | 11/2011 | Chen |
| 2015/0291259 | A1 | 10/2015 | Perosino et al. |

FOREIGN PATENT DOCUMENTS

| | | |
|---|---|---|
| JP | 06090605 | 4/1984 |
| WO | 2008010909 | 1/2008 |

OTHER PUBLICATIONS

Birnini Top Retraction System (Schwintek, Inc.) as described in the Background of Applicant's specification and illustrated in Fig. 1 of U.S. Pat. No. 7,921,797, known to be on sale or publicly available before Mar. 14, 2007.

Hinge: Dowco, Inc.; prior art for purposes of prosecution, Mar. 3, 2020.

Peloton Precision Bicycle Products Hitch Perfect : Kuat NV product information; 2014 Move Press LLC.

Website screenshot of Dowco Marine Inc.; https://www.dowcomarine.com/; obtained from Internet Archive Jun. 23, 2015.

Website screenshot of Dowco Replacement Aft Top Canopy; Prior art for purposes of prosecution, May 3, 2020.

Website screenshot of PWR-ARM Automatic Bimini Top: https://pwr-arm.com; obtained from the Internet Archive Jun. 15, 2013.

Website screenshot of YouTube; PWR-ARM II, by Schwintek Inc.; uploaded on Oct. 19, 2011.

* cited by examiner

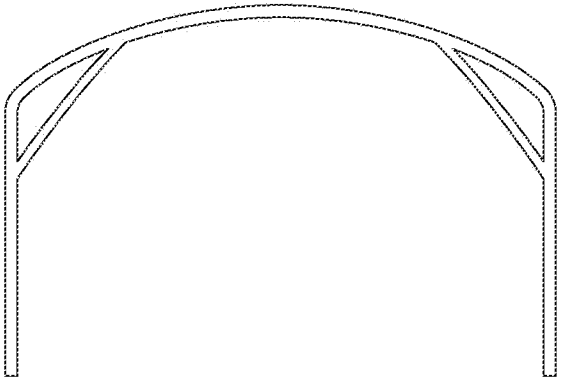
FIG. 11A
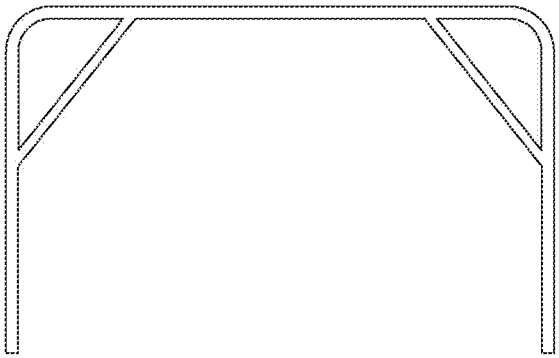
FIG. 11B
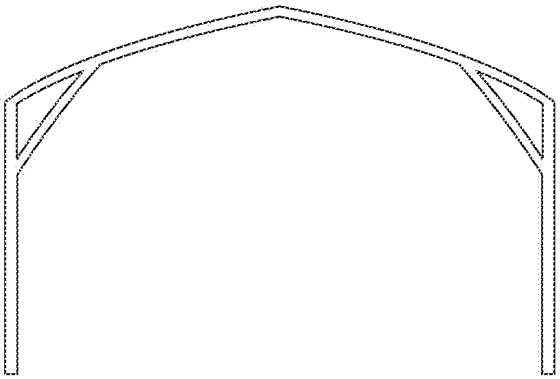
FIG. 11C
FIG. 11D
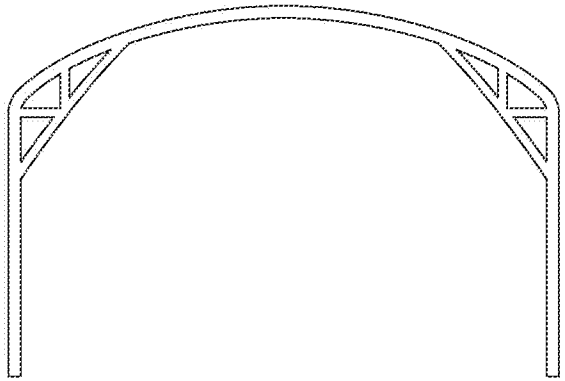
FIG. 11E
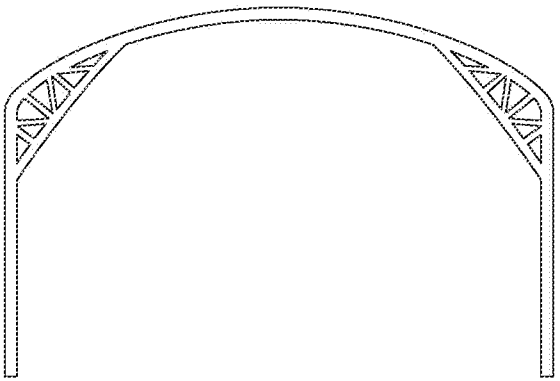
FIG. 11F

REINFORCED ARTICULATED TOP

CROSS REFERENCE TO RELATED APPLICATION

This continuation application is based on and claims benefit of and priority to U.S. application Ser. No. 17/808,473, filed Jun. 23, 2022, a continuation application that is based on and claims the benefit of and priority to U.S. application Ser. No. 17/482,358, filed Sep. 22, 2021, a continuation-in-part application that is based on and claims the benefit of and priority to U.S. application Ser. No. 17/302,963, filed May 17, 2021, which is based on and claims the benefit of and priority to U.S. Pat. No. 11,046,394, filed May 4, 2020, which are incorporated herein by reference in their entirety for all purposes.

FIELD OF THE INVENTION

The present invention relates generally to the field of water craft. More specifically, the present invention relates to articulating tops for water craft.

BACKGROUND

Boats can be equipped with some form of sun shade apparatus or other enclosure such as a top, canopy or bimini. Some tops can be moved between a first, stowed, collapsed or trailering position and a second, extended or deployed position. Some tops are constructed out of tubular frames that articulate to at least two positions and, sometimes, a third, radar position. Some such tops can be manually articulated to a desired position, while others utilize mechanical aids such as hydraulics or electric motors to power the apparatus into the desired position(s).

Most tops are not intended for use in a deployed position while the vehicle is in motion at a high speed. However, even when the vehicle is in motion at a slow speed or if there is significant wind, a deployed top can catch the wind, e.g. like a parasail or parachute, which exerts significant force on the top. For example, if the top catches the wind, the top may be urged back towards the stowed or radar positions. If the top was locked in the deployed position, such rotational force could damage the frame members resulting in the failure of the top and/or damage to the vehicle. Similarly, if the top catches the wind, the top might create drag away from the vehicle causing significant tensile force on the frame members, means of attaching the top to the vehicle and/or the vehicle itself. Such tensile force could damage the frame members resulting in the failure of the top and/or damage to the vehicle.

To resists such forces, some tops 2, such as seen in FIG. 1, utilize a frame member such as bar or strap 4 that is attached to the front and/or rear of the top at one end and to the vehicle 6 at the other end. Often, bars 4 are used on each side, port and starboard, at the front and/or rear. Such bars 4 secure the front and/or rear of the top 2 to the vehicle 6 and resist the top from being urged backwards such that the top catches the wind to an extent that damaging forces are transmitted to the frame members.

One disadvantage of such bars 4 is that some are permitted to be attached and detached when the top 2 is deployed and stowed, respectively. Often, bars 4 are attached and detached to connectors that are permanently or semi-permanently attached to the vehicle 6. The connectors are often considered aesthetically undesirable and can create weak points in the vehicle, e.g. holes for attachment in the fiberglass. Another disadvantage is that the typical location of a top 2 results in the front bars 4 being located on one side near where the captain's seat 8, throttle, controls, windscreen and/or other aftermarket accessories, e.g. fish finders, are located, such as seen in FIG. 1. The other side of the front bar 4 is often located near or on the location of a gate 9 for egress and ingress. Such locations make the captain's seat 8, throttle, controls, windscreen, aftermarket accessories and/or gate 9 inconvenient to use or partially unusable, and can create safety hazards, for example visual obstructions. In some cases, the larger footprint of the top's connection to the vehicle requires the vehicle to have reinforcement added to a larger area of the vehicle. Such additional connectors and reinforcement add cost to such tops 2 as well as the installation.

Some self powered tops, for example U.S. Pat. Nos. 8,752,498, 7,438,015 and 7,389,737 to Lippert Components Manufacturing, Inc., include a central hub attached to a marine vehicle, often on each side, port and starboard, of the vehicle. The central hubs raise each side of one more of the frame members into a deployed position, which pulls, via the canvas cover, other frame members into the deployed position. Some such powered tops do not utilize bars and instead use a robust central hub and frame members, e.g. thicker walls, to resist the forces acting on the top. Even then, operating instructions for the commercial embodiment of the top disclosed in U.S. Pat. Nos. 8,752,498, 7,438,015 and 7,389,737 warns not to operate the top when the marine vehicle is in motion or in strong winds. Further, the small area of the central hub concentrates the forces from the powered top to a small area of the vehicle to which it is attached. This can cause damage to the vehicle or require additional supporting structure added to the vehicle to handle such forces. Such additional reinforcement can add cost to such tops as well as the installation.

Therefore, there is a need for a reinforced top that can resist the forces of wind and be operated during movement of the vehicle.

It will be understood by those skilled in the art that one or more claims and/or aspects of this invention or embodiments can meet certain objectives, while one or more other claims, embodiments and/or aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

BRIEF DESCRIPTION OF THE DRAWINGS

FIG. 11A is a side elevational view of one embodiment of a frame member.

FIG. 11B is a side elevational view of another embodiment of a frame member.

FIG. 11C is a side elevational view of one embodiment of a frame member.

FIG. 11D is a side elevational view of one embodiment of a frame member.

FIG. 11E is a side elevational view of one embodiment of a frame member.

FIG. 11F is a side elevational view of one embodiment of a frame member.

DETAILED DESCRIPTION

Figure 1:
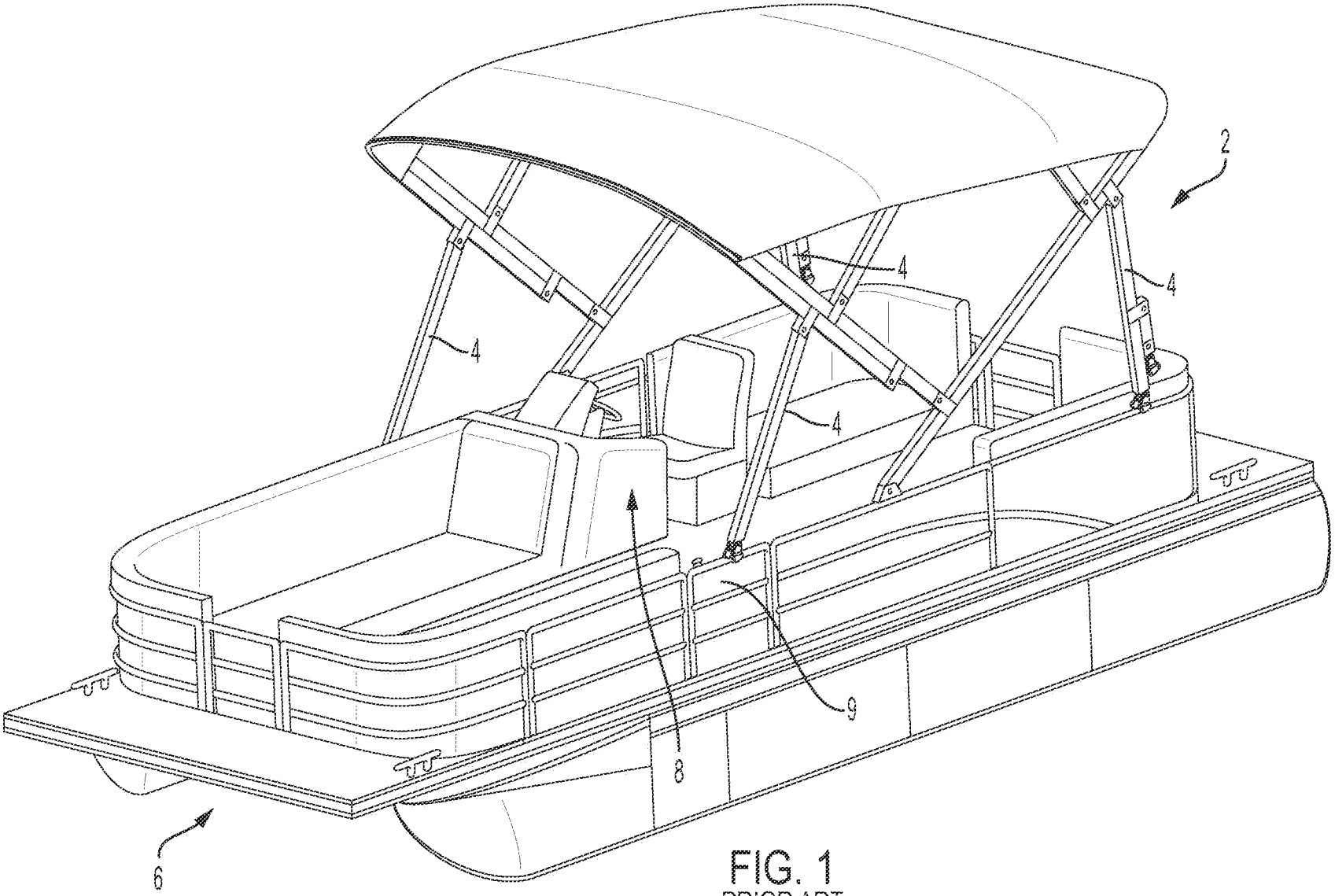
FIG. 1 PRIOR ART
FIG. 1 is a perspective view of a prior art marine vehicle and top.
Figure 2:
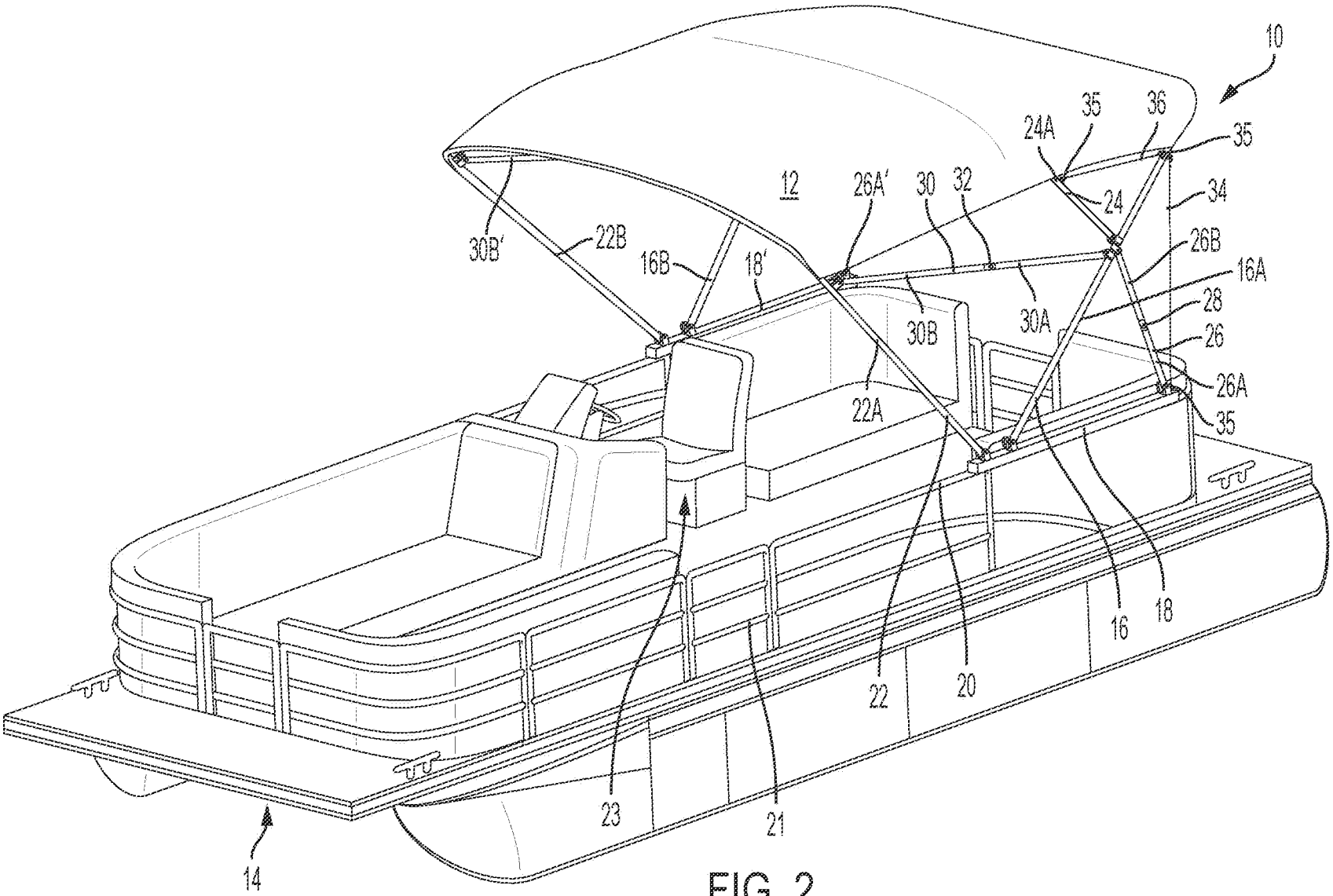
FIG. 2 is a perspective view of a marine vehicle and one embodiment of the top of the invention.
Figure 3A:
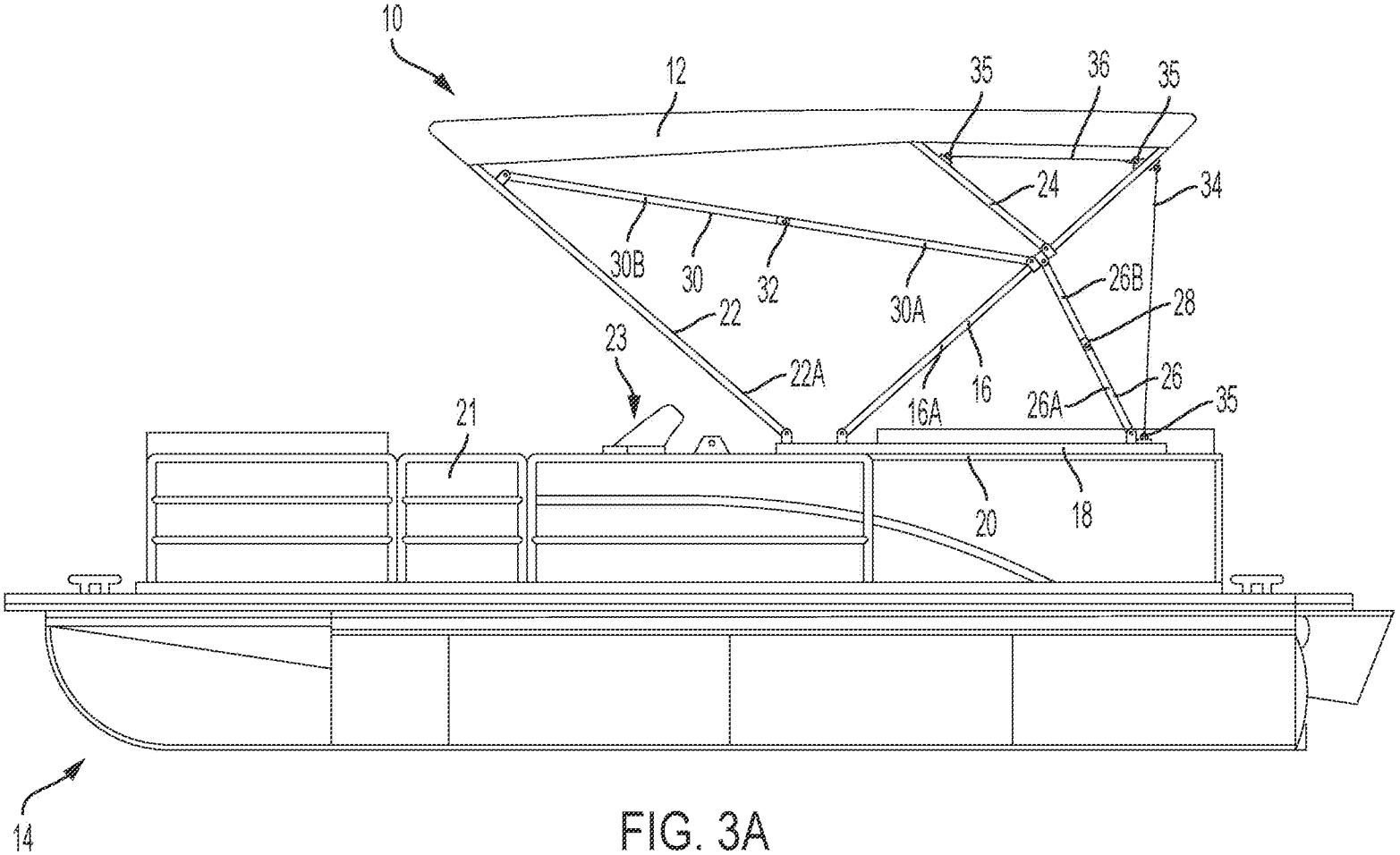
FIG. 3A is a port side elevation view of the top of FIG. 2 in the deployed position.
Figure 3B:
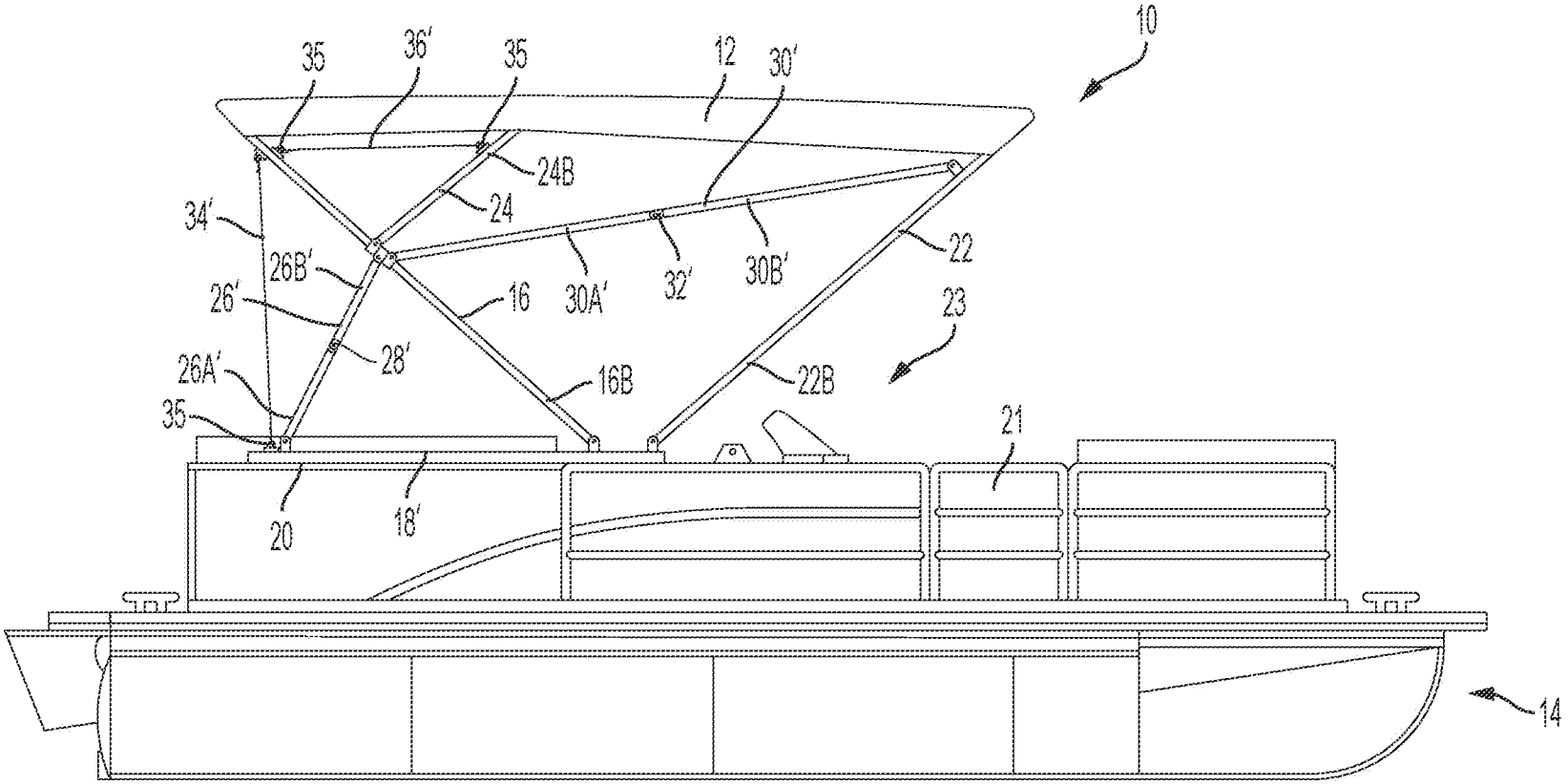
FIG. 3B is a starboard side elevation view of the top of FIG. 2 in the deployed position.
Figure 4:
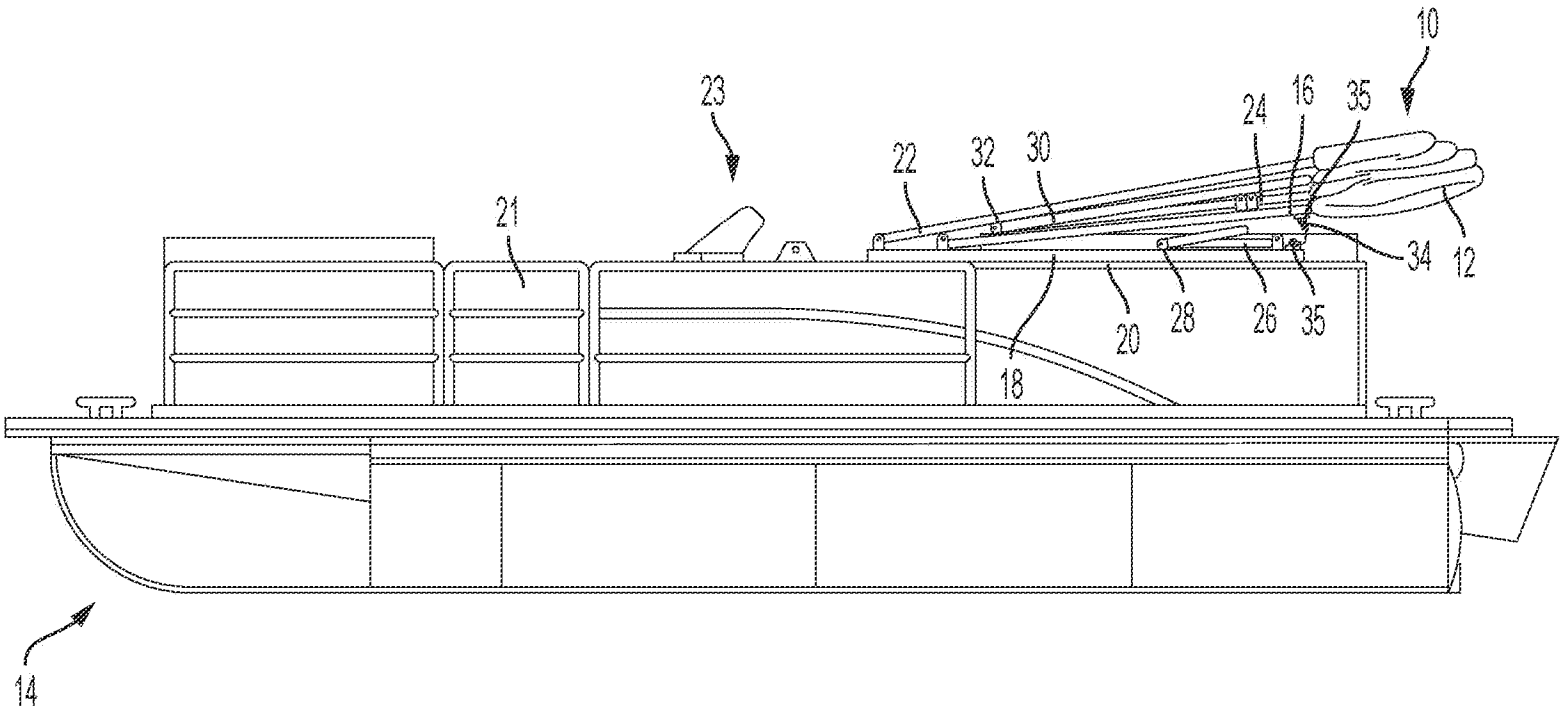
FIG. 4 is a port side elevation view of the top of FIG. 3A with the top in the stowed position.
Figure 5:
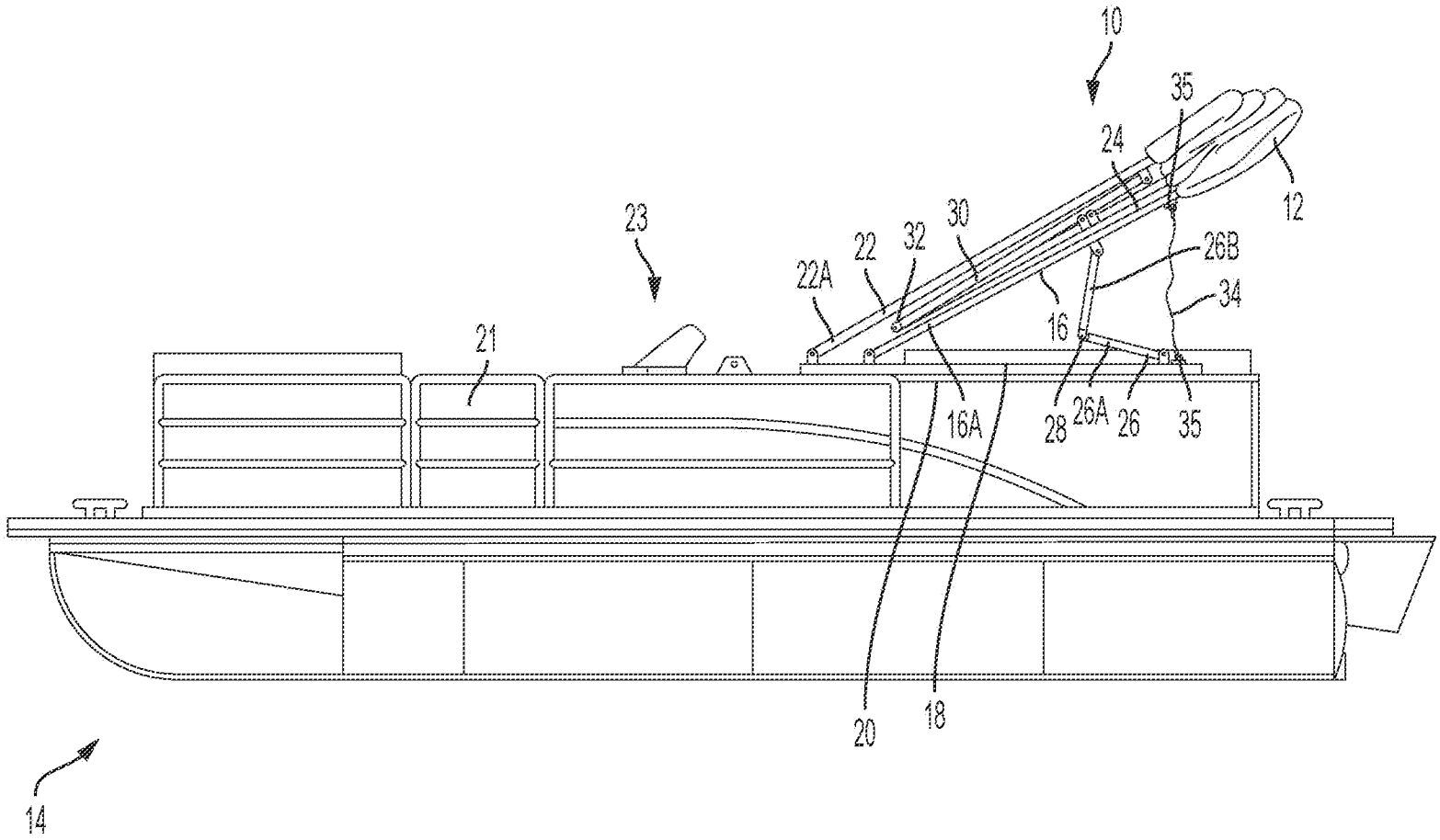
FIG. 5 is a port side elevation view of the top of FIG. 3A with the top in a partially raised position.
Figure 6:
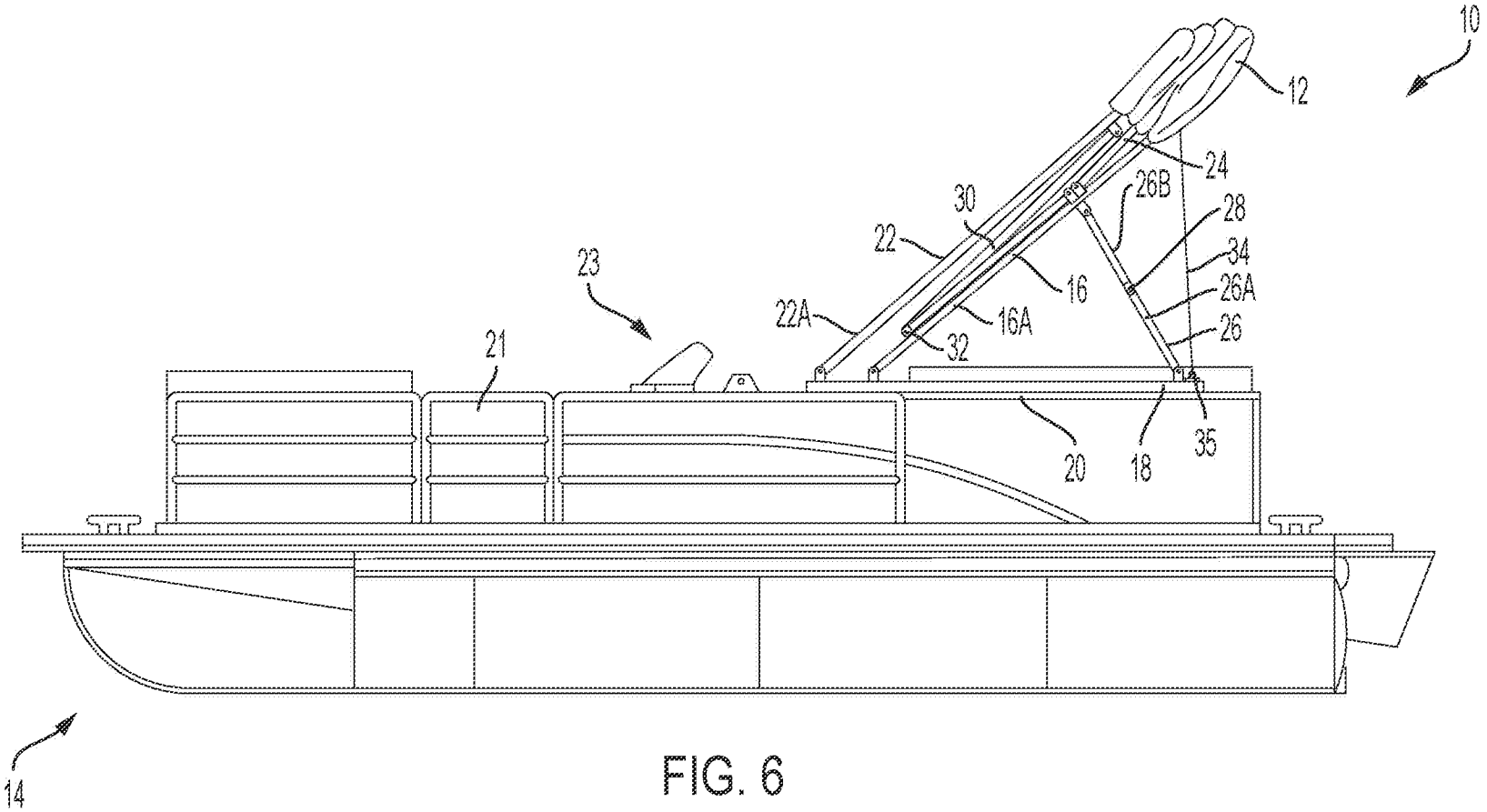
FIG. 6 is a port side elevation view of the top of FIG. 3A with the top in the radar position.
Figure 7:
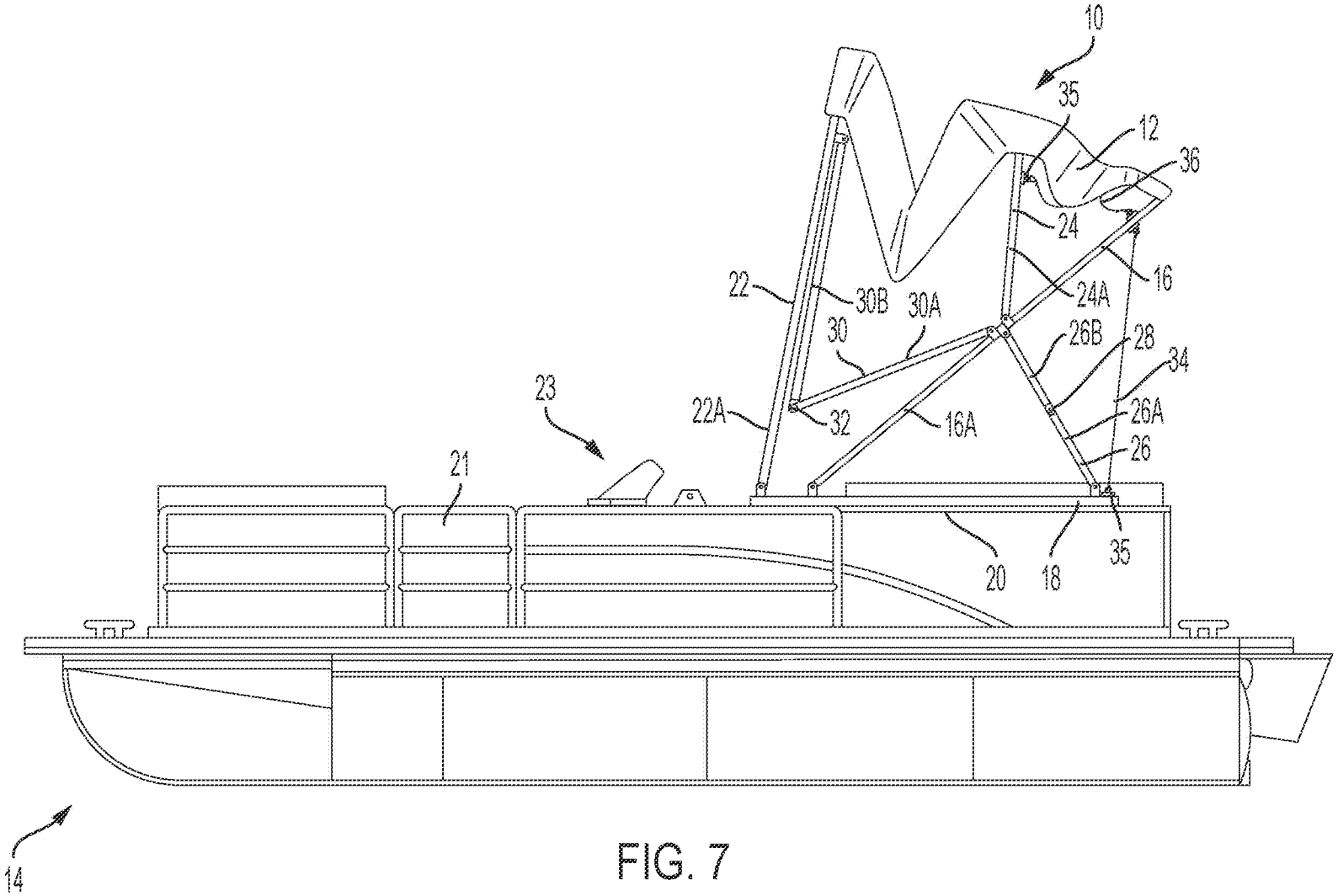
FIG. 7 is a port side elevation view of the top of FIG. 3A with the top in another partially raised position.

As seen in FIG. 2-7, a frame for a structure referred to as a marine top, canopy or bimini 10 is shown. The frame of the top 10 shown in FIG. 2 is generally comprised of frame members that support a cover or covering 12, which can be made from canvas or other suitable material, for providing shade or sheltering from the elements, such as to a vehicle 14. The top 10 is configured to be moved between a stowed or trailering position (as seen in FIG. 4), for use when the vehicle 14 to which it is attached is being transported such as on a trailer or when stored, and a deployed position (as seen in FIG. 3A), for use when shade or shelter from the elements is desired. The top 10 may also be moved to a radar position (as seen in FIG. 6), which is between the stowed position and deployed position, for use when the vehicle is in use, but the top is not needed for shelter or if only a small amount of shelter from the elements is desired.

The top 10 embodiment seen in FIG. 3A includes frame having a main frame member or aft bow 16 that is pivotally or rotatably connected or attached to a mounting bracket or mount 18. The mounting bracket 18 provides pivotal or rotatable connection between the frame members and the vehicle 14 such that the frame can be moved between a stowed or trailering position and a deployed position. The mounting bracket 18 attaches the frame, and thereby the top 10, to a structure, such as to a wall or rail 20 of a vehicle 14. While the embodiment shown is of a pontoon-style boat, it is understood by those skilled in the art that the top could be used in a similar fashion on other vehicles, including but not limited to, sport boats, V-hull boats, flat bottom boats, ATVs, UTVs, etc.

The mounting bracket 18 (and/or the railing 20 or mounting surface) is configured to disperse the forces, for example from raising and lowering or from wind when the frame is deployed, along a greater area of the rail 20 of the vehicle 14 as compared to attaching the individual frame members directly to the rail of the vehicle subjecting the rail to greater point loads. The mounting bracket 18 shown in FIG. 2 also avoids inconveniencing or interfering with the gate 21 or the captain's seat or the throttle, controls, windscreen and/or aftermarket accessories often located in the captain's area 23.

A secondary frame member or forward bow 22 is also attached to the mounting bracket 18. Alternatively, the secondary frame member 22 could be attached to the main frame member 16. In the embodiment seen in FIG. 3A, the secondary frame member 22 is pivotally or rotatably attached to the mounting bracket 18. The secondary frame member 22 is attached on a first or forward side of the position where the main frame member is attached to the mounting bracket 18.

The main frame member 16 and the secondary frame member 22 are also attached to the covering 12 such that as the frame members are moved to the deployed position, for example the portion of the main frame member that is attached to the covering is moved away or remote from the portion of the secondary frame member attached to the covering, the covering will be expanded or unfolded. As the frame members 16, 22 are moved to the stowed position, the covering 12 will be folded or contracted. In one embodiment, the frame members 16, 22 are attached to the covering 12 by extending through sleeves formed in the underside of the covering. However, other means of attaching frame members to a covering are known in the industry, for example, the use of straps, snaps, fasteners, etc., the use of which would not defeat the spirit of the invention.

In the embodiment seen in FIG. 3A, the main frame member 16 and the secondary frame member 22 are attached to and support the covering 12 at the rear and front of the covering. One or more auxiliary bows or auxiliary frame members 24 can be connected to the main and/or secondary frame member 16, 22. In the embodiment seen in FIG. 3A, an auxiliary bow 24 is attached to the main frame member 16 to provide additional support to the covering 12. The auxiliary bow 24 could also be attached to the covering 12 as described above with respect to the main and secondary frame members 16, 22. The auxiliary bow 24 can be pivotally or rotatably attached to the main frame member 16 such that as the main frame member 16 and the secondary frame member 22 are moved to the deployed position, the covering 12 will expand and in some embodiments, be pulled taught therebetween. Because the auxiliary bow 24 is connected to the covering 12, as the covering expands, the covering will cause the auxiliary bow to be rotated and pull it to its deployed position wherein the portion of the auxiliary bow attached to the covering will be remote from the portion of the main frame member attached to the covering.

As seen in FIG. 3A, the frame includes an aft or rear strut 26 attached to the main frame member 16. When the top 10 is the deployed position, the rear strut 26 is extended and/or in an unfolded position, provides support to the top 10 via the main frame member 16 and prevents the main frame member from bending. In one embodiment, the rear strut 26 is capable of collapsing into a generally flat or folded position in order to permit the top 10 to be collapsed. As seen in FIG. 3A, the rear strut 26 has a hinge 28 that attaches a first portion 26A of the rear strut to a second portion 26B of the rear strut and permits the rear strut to fold in half and be located between the vehicle 14 and the main frame member 16 when the top 10 is in the stowed position.

In the embodiment seen in FIG. 3A, the first portion 26A of the rear strut 26 is pivotally or rotatably attached to the mounting bracket 18 (for example, on a second or aft side of the position where the main frame member is attached to the mounting bracket) and the second portion 26B of the rear strut 26 is pivotally or rotatably attached to the main frame member 16 such that when extended the main frame member and secondary frame member are in a raised position. However, other means of permitting a frame member to move to a generally flat position are known in the art including permitting one end of the frame member to slide, telescoping, etc., the use of which would not defeat the spirit of the invention.

To decrease the amount of point loads on the vehicle 14 from the top 10, the mounting bracket 18 can be extended further towards the rear of the vehicle such that the end of the rear strut 26 is attached to the mounting bracket. Forces transferred to the rear strut 26 from the top 10 can be transferred to the vehicle 14 along a greater surface area of the rail 20 generally in the location of the mounting bracket.

The top 10 could also include a second or forward strut 30. In the embodiment shown in FIG. 3A, the forward strut 30 is located between and attached to the main frame member 16 and the secondary frame member 22. Like the rear strut 26, the forward strut 30 may also include a hinge 32 that attaches a first portion 30A of the rear strut to a second portion 30B of the rear strut and permits the rear strut to fold in half. The first portion 30A of the forward strut 30 is pivotally or rotatably attached to the main frame member 16 and the second portion 30B of the forward strut is pivotally or rotatably attached to the secondary frame member 22. The forward strut 30 can be collapsed into a first or folded position and located between the main frame member 16 and the secondary frame member 22 when the top 10 is in the stowed position or extended into a second or unfolded position such that secondary frame member 22 is in a deployed or second raised position.

In the embodiment seen in FIG. 3A, the forward strut 30 is attached to the main frame member 16 in close proximity or adjacent to the location or position the rear strut 26 is attached to the main frame member. This configuration permits forces acting on the top 10, to be transmitted to the forward strut 30, to the rear strut 26 and ultimately, the vehicle 14. The auxiliary frame member 24 may also be attached to the main frame member 16 in close proximity or adjacent to the location the rear strut 26 is attached to the main frame member to efficiently transfer forces from the auxiliary frame member.

While the forward strut 30 and rear strut 26 help transfer compressive forces from the top 10 to the vehicle 14, for example, a force pushing or pulling the forward end of the top 10 upwards, tensile forces may also act on the top 10, e.g. forces pushing or pulling the forward end of the top downwards. In one embodiment, the top 10 includes braces that resist the tensile forces. In the embodiment seen in FIG. 3A, a rear brace 34 is attached between the vehicle 14 and the main frame member 16. To decrease the amount of point loads on the vehicle 14, from the top 10, the rear brace 34 may be attached to the vehicle by a mounting bracket 18. In one embodiment a pad eye bracket 35 is attached to the mounting bracket 18 or integrally formed therewith. The rear brace 34 extends through the pad eye 35 and is then attached back to itself to attach the rear brace to the vehicle 14. The rear brace 34 may also be attached to the main frame member 16 by a pad eye bracket 35 attached thereto or integrally formed therewith. Tensile forces acting on the main frame member 16 may be transferred to the rear brace 34 and then to the vehicle 14 along a greater surface area of the rail 20 generally in the location of the mounting bracket.

Figure 13:
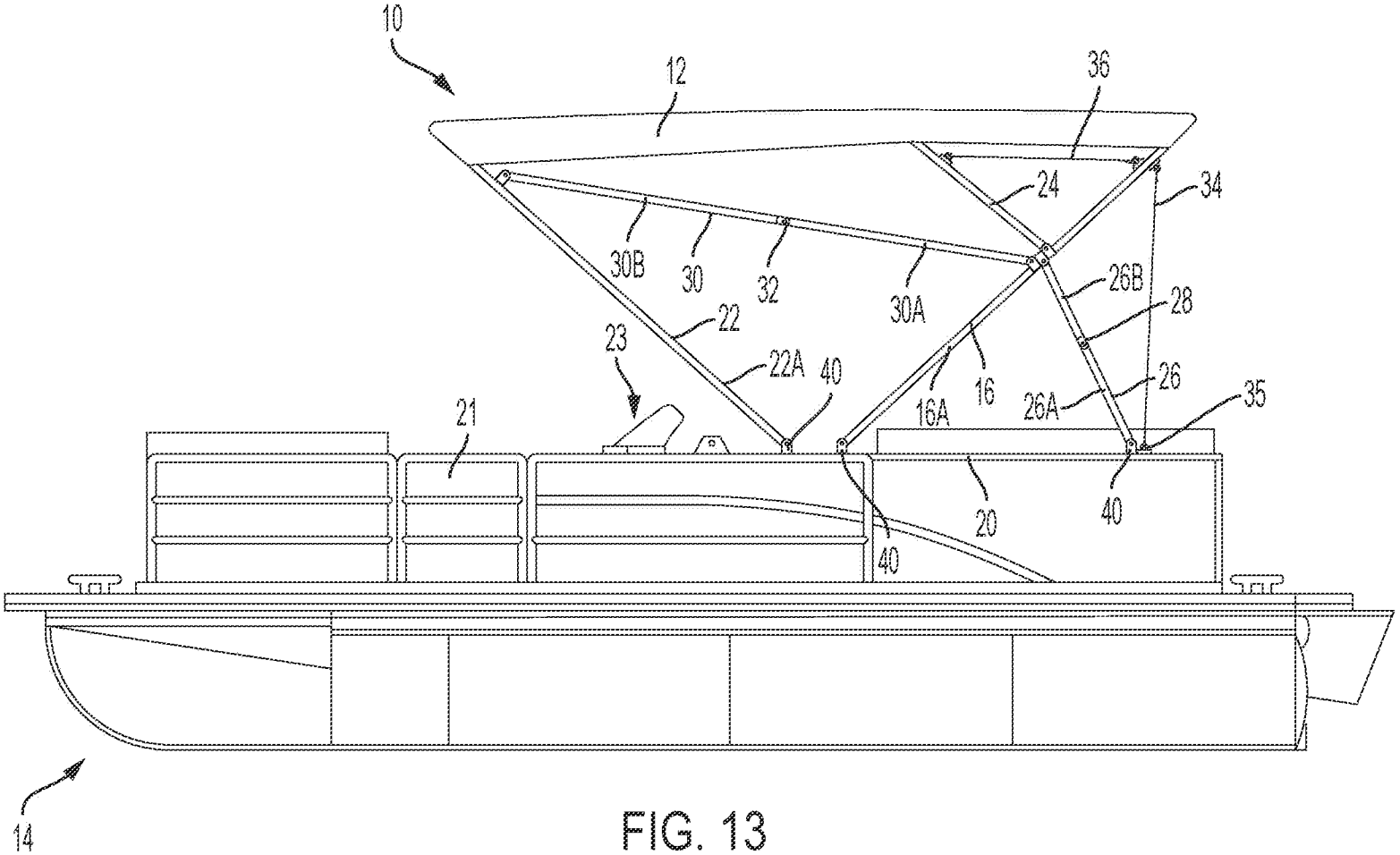
FIG. 13 is a port side elevation view of an alternative embodiment of a top in the deployed position.

A second or forward brace 36 may be used between and attached to the auxiliary frame member 24 and another frame member, such as, for example, pad eye brackets 35 discussed above. In one embodiment seen in FIG. 3B, the forward brace 36 helps prevent tensile force from causing the auxiliary frame member 24 to be pulled away from the main frame member 16 and possibly tearing the covering 12 therebetween. While the forward brace 36 is located in a position where it is accessible and visible in FIG. 3A it could also be located under, on top of or between layers of the covering 12. While tensile forces may act to pull the secondary frame member 22 away from the auxiliary frame member 24 and/or the main frame member 16, and possibly tearing the covering 12 therebetween, the forward strut 30 can also help relieve such forces. In another embodiment seen in FIG. 13, the forward brace 36 helps prevent tensile force from causing the auxiliary frame member 24 to be pulled away from the secondary frame member 22 and possibly tearing the covering 12 therebetween.

When the top 10 is in the stowed position, the rear brace 34 and forward brace 36 are collapsed as seen in FIG. 4. When the top 10 is in the radar position and deployed position, the rear brace 34 is extended and taught as seen in FIGS. 6, 2. When the top 10 is in the deployed position, the forward brace 36 is extended and taught as seen in FIG. 2.

In one embodiment, the rear brace 34 and the forward brace 36 are capable of being deformed to permit the top 10 to be able to be moved into a stowed position. In the embodiment seen in FIG. 3A, the rear brace 34 and/or forward brace 36 are made from a braided steel cable material such that when the top 10 is moved to the stowed position, the rear brace and/or forward brace can deform to permit the top to collapse. However, other materials, for example a nylon strap, wire rope, chain, composite cord, etc. and/or other means for deforming a brace are known in the industry, for example a hinge as seen in the forward strut 30, sliding one end, telescoping, using a wire of other resilient material, etc., the use of which would not defeat the spirit of the invention. The use of a steel cable or wire, makes the top 10 more cost effective to manufacture, lighter weight, minimizes obstruction and permits the top to collapse into a thinner profile.

Figure 8:
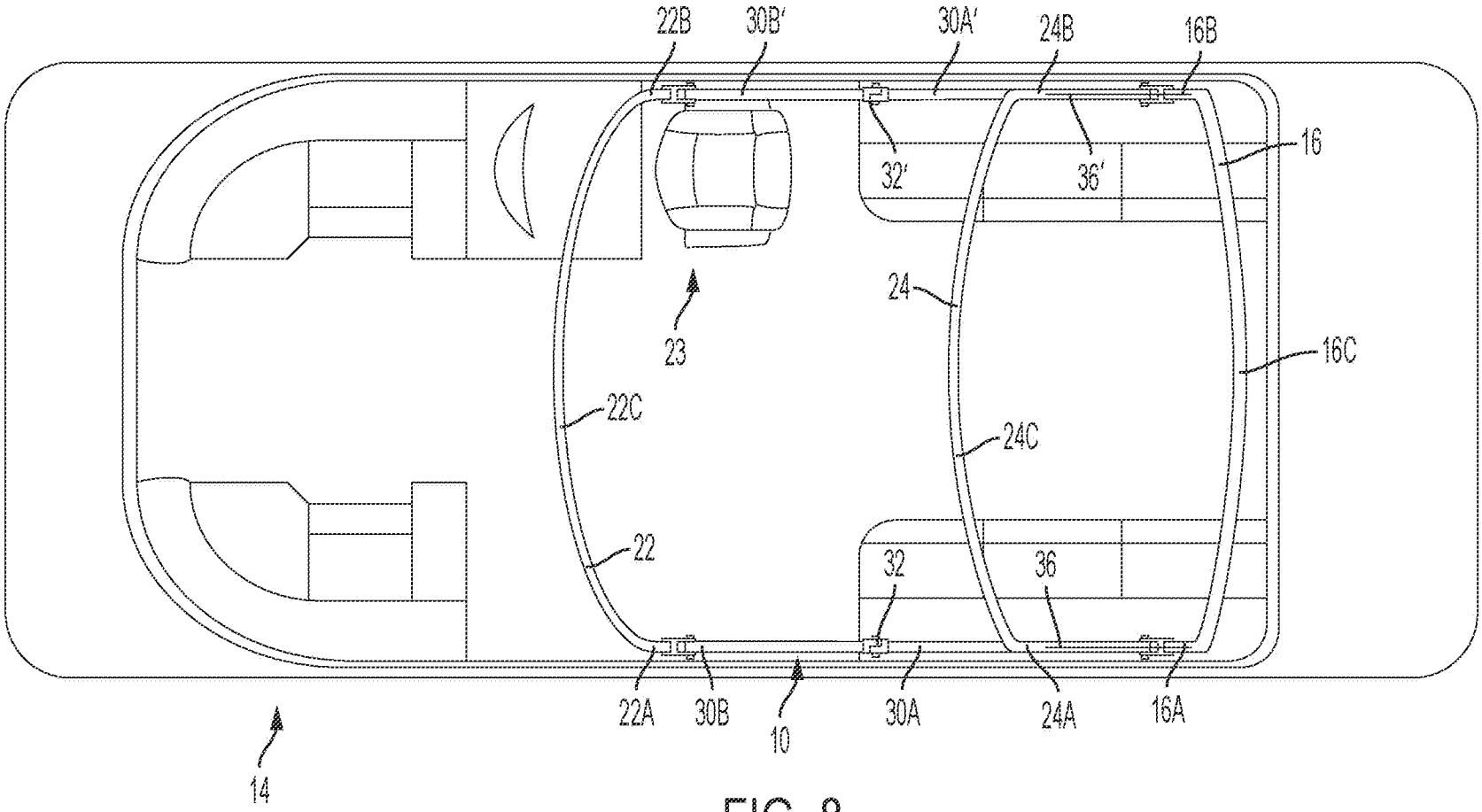
FIG. 8 is a top plan view of the marine vehicle and top with the covering removed.
Figure 9A:
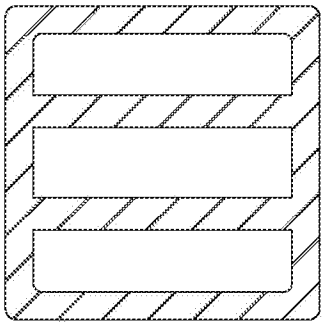
FIG. 9A is a crosswise cross-sectional view of one embodiment of a frame member.
Figure 9B:
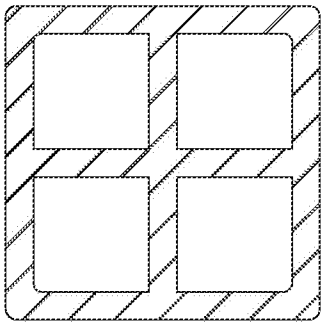
FIG. 9B is a crosswise cross-sectional view of another embodiment of a frame member.
Figure 9C:
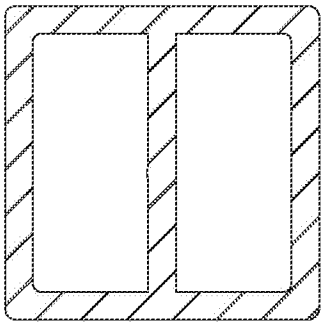
FIG. 9C is a crosswise cross-sectional view of another embodiment of a frame member.
Figure 9D:
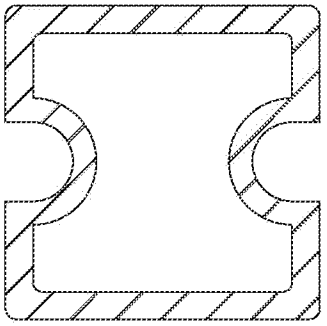
FIG. 9D is a crosswise cross-sectional view of another embodiment of a frame member.
Figure 9E:
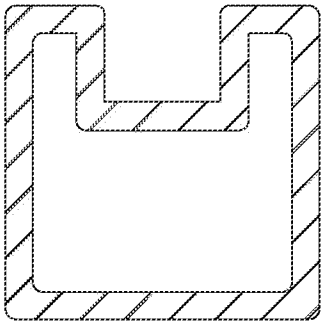
FIG. 9E is a crosswise cross-sectional view of another embodiment of a frame member.
Figure 9F:
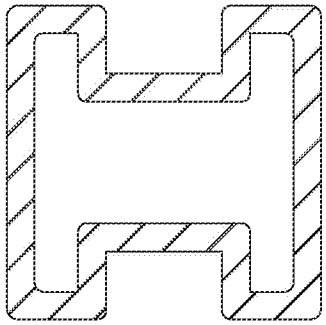
FIG. 9F is a crosswise cross-sectional view of another embodiment of a frame member.
Figure 9G:
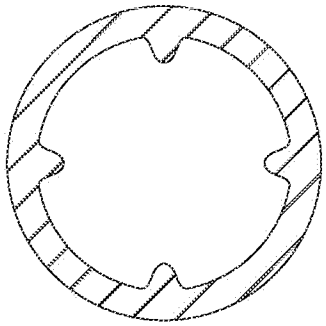
FIG. 9G is a crosswise cross-sectional view of another embodiment of a frame member.
Figure 9H:
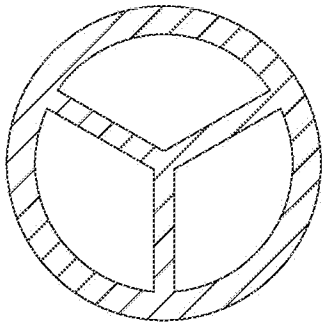
FIG. 9H is a crosswise cross-sectional view of another embodiment of a frame member.
Figure 9I:
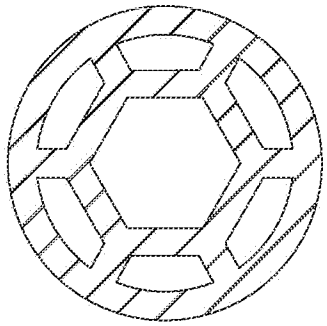
FIG. 9I is a crosswise cross-sectional view of another embodiment of a frame member.
Figure 9J:
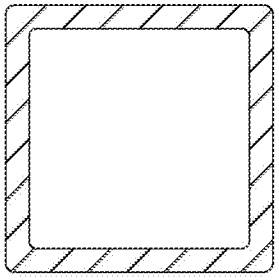
FIG. 9J is a crosswise cross-sectional view of another embodiment of a frame member.
Figure 9K:
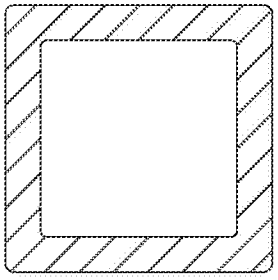
FIG. 9K is a crosswise cross-sectional view of another embodiment of a frame member.
Figure 9L:
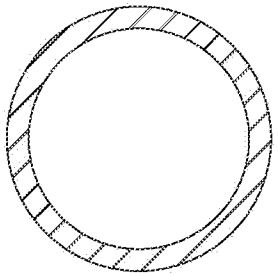
FIG. 9L is a crosswise cross-sectional view of another embodiment of a frame member.
Figure 9M:
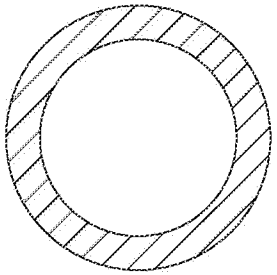
FIG. 9M is a crosswise cross-sectional view of another embodiment of a frame member.

As seen in FIG. 8, the top 10 provides shade to the captain's seat and captain's area. However, the frame members do not interfere with or otherwise inconvenience the captain's area 23, the other components in that area or use of the gate 21 because they are located remote from the same.

In one embodiment, a mounting bracket 18, rear strut 26, forward strut 30, rear brace 34, forward brace 36 are located on each side of the top, for example a first mount 18, first or port aft strut 26, first or port forward strut 30, port brace 34, and port forward brace 36 on the port side as seen in FIG. 3A and a second mount 18', second or starboard aft strut 26', second or starboard forward strut 30', starboard brace 34' and starboard forward brace 36' on the starboard side seen in FIG. 3B. However, other configurations could be used without defeating the spirit of the invention.

Figure 10C:
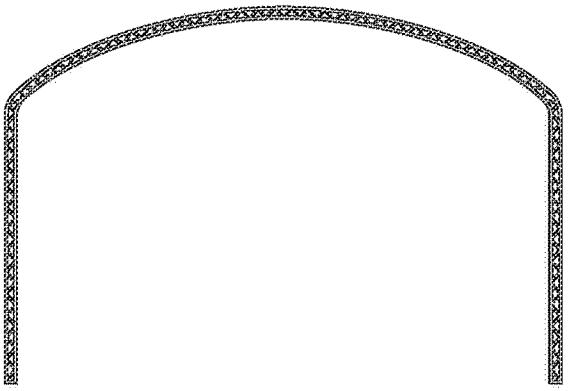
FIG. 10C is a lengthwise cross-sectional view of another embodiment of a frame member.
Figure 10B:
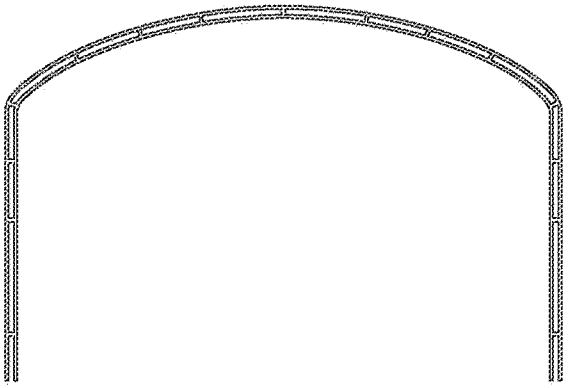
FIG. 10B is a lengthwise cross-sectional view of another embodiment of a frame member.
Figure 10A:
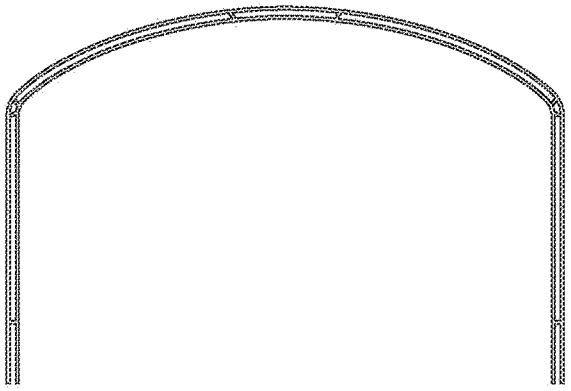
FIG. 10A is a lengthwise cross-sectional view of one embodiment of a frame member.

In the embodiment shown above, the frame members such as the main frame member 16, secondary frame member 22 and auxiliary frame member 24 are depicted as a bow, e.g. a structural element having a port leg portion 16A, 22A, 24A and a starboard leg portion 16B, 22B, 24B connected by a generally curved middle portion 16C, 22C, 24C. In one embodiment, the port leg portions 16A, 22A are rotatably attached to the first mount 18 and the starboard leg portions 16B, 22B are rotatably attached to the second mount 18'. Likewise, the port leg portion 24A of the auxiliary frame member 24 is rotatably attached to the port leg portion 16A of the main frame member 16 and the starboard leg portion 24B of the auxiliary frame member is rotatably attached to the starboard leg portion 16B of the main frame member. However, the use of other configurations of frame members, for example, square, triangular, oval, circular, comprised of a number of components, etc., would not defeat the spirit of the invention, some examples of which can be seen in FIGS. 10A-10C. Further, the frame members could include corner bracing or truss configurations, some examples of which can be seen in FIG. 11A-11F.

In the embodiment shown above, the frame members such as the main frame member 16, secondary frame member 22 and auxiliary frame member 24 are depicted as being square or round tubular members. However, the use of other cross-sectional shapes of frame members, for example, oval, being solid, having thicker walls or having internal structures, would not defeat the spirit of the invention, some examples of which are seen in FIGS. 9A-9M.

In some cases, the frame members such as the main frame member 16, secondary frame member 22 and auxiliary frame member 24 will be urged to expand laterally, for example in the direction from starboard side to port side, due to forces acting on the covering 12 and/or frame. Reinforcing the frame members, such as by using different cross-sectional shapes, internal structures and/or corner bracing or truss configurations can help resist such lateral expansion. Further, additional bracing, like that disclosed with respect to the rear braces 34 and forward braces 36 could be used laterally, for example, from the starboard side of the main frame member 16 to the port side of the main frame member.

Figure 12:
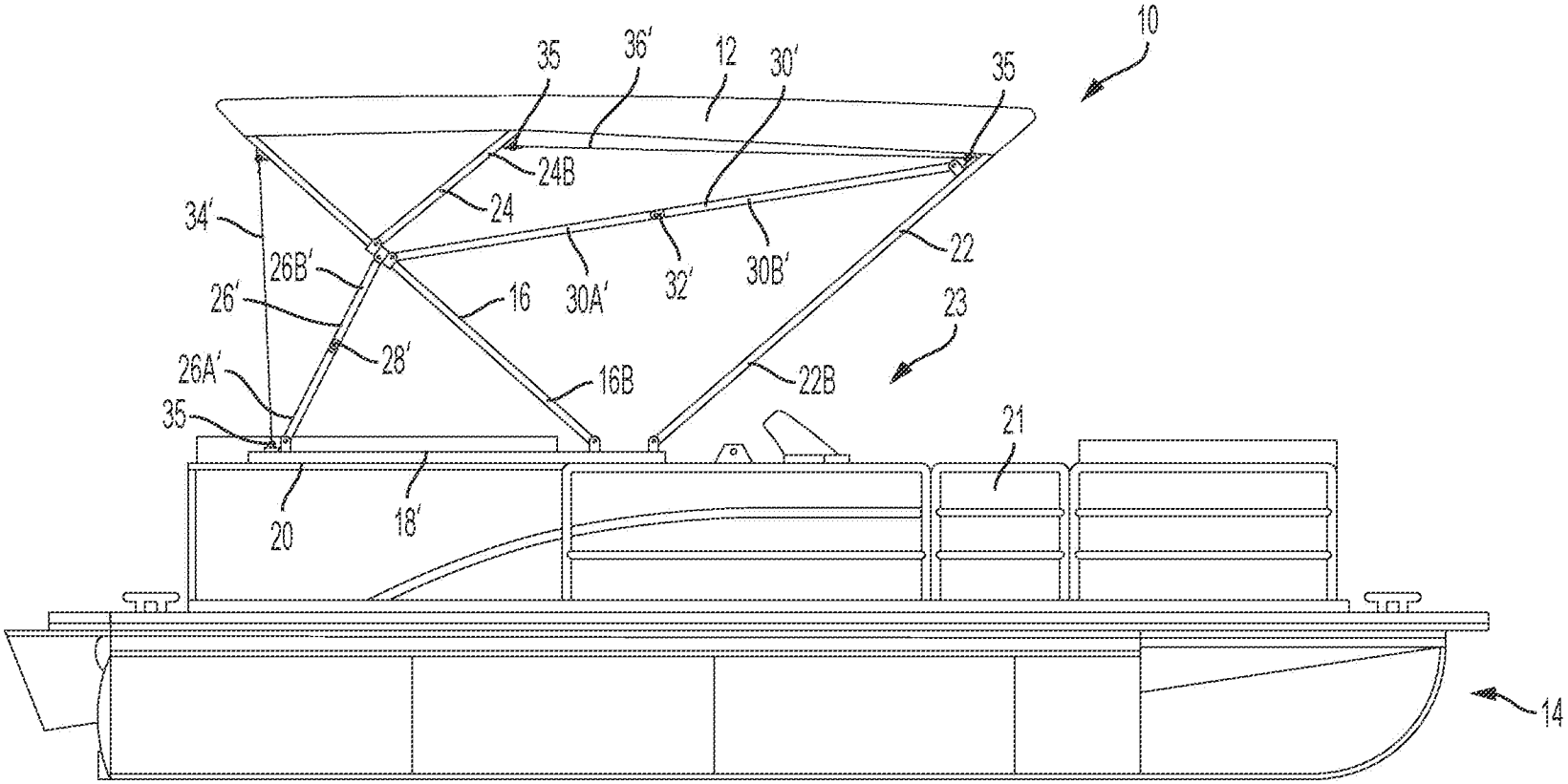
FIG. 12 is a starboard side elevation view of an alternative embodiment of a top in the deployed position.

In an alternative embodiment, one or more of the frame members have their own mounting bracket or be individually attached to the rail 20 of the vehicle 14. As seen in FIG. 12, the main frame member 16, secondary frame member 22, rear struts 26, 26' and rear braces 34, 34' are attached to individual mounting brackets 40. Some of the frame members may be combined onto the same individual mounting bracket 40, for example the rear struts 26, 26' and rear braces 34, 34', respectively.

In an alternative embodiment, the top 10 may be powered such that the top may be moved between the first, raised or deployed position and the second or stowed position, and alternatively the radar position, entirely on its own or in a partial manner so as to permit the top to be more easily moved by a person. In one embodiment, the main and/or secondary frame members 16, 22 could be powered, such as by a motorized hub with integrated hinges and/or mechanical levers. In one embodiment, the hinges 28, 32 could be powered to be able to open and close. Other means to (un)fold the hinges 28, 32 and/or the rear strut(s) 26 and/or the forward strut(s) 30 can include cables, pullies, winches, motors, actuators, springs, lead screws, levers, gears such as spur, rack and pinion, worm, bevel, pressurized components such as pistons, bladders, balloons, etc., the use of which would not defeat the spirit of the invention.

By way of one example, one or more of the struts 26, 30 could be powered by a biasing member such as a gas shock, a mechanical or pneumatic spring, shock and/or damper, as disclosed for example, in U.S. Pat. Nos. 9,849,939, 9,815,525, 9,783,266, and 9,604,702, owned by the owner of the present application, and which are hereby incorporated herein for all purposes. Alternatively, or in addition, the frame members could be driven by gears such as disclosed in U.S. Pat. Nos. 8,752,498, 7,438,015 and 7,389,737 to Lippert Components Manufacturing, Inc.

In one powered embodiment, an actuator 42, such as a linear actuator, can be attached to the frame, and moved between a first position and a second position to raise and lower at least a portion of the frame. The actuator could be a linear rod actuator, gas shock, mechanical or pneumatic spring, shock, damper, powered hinge, cam and follower, cycloidal gear box or other similar type of device that cases movement. In one embodiment as seen FIGS. 15-21, a first or rear actuator 42 and a forward or second actuator 44 is used with the frame.

Figure 15:
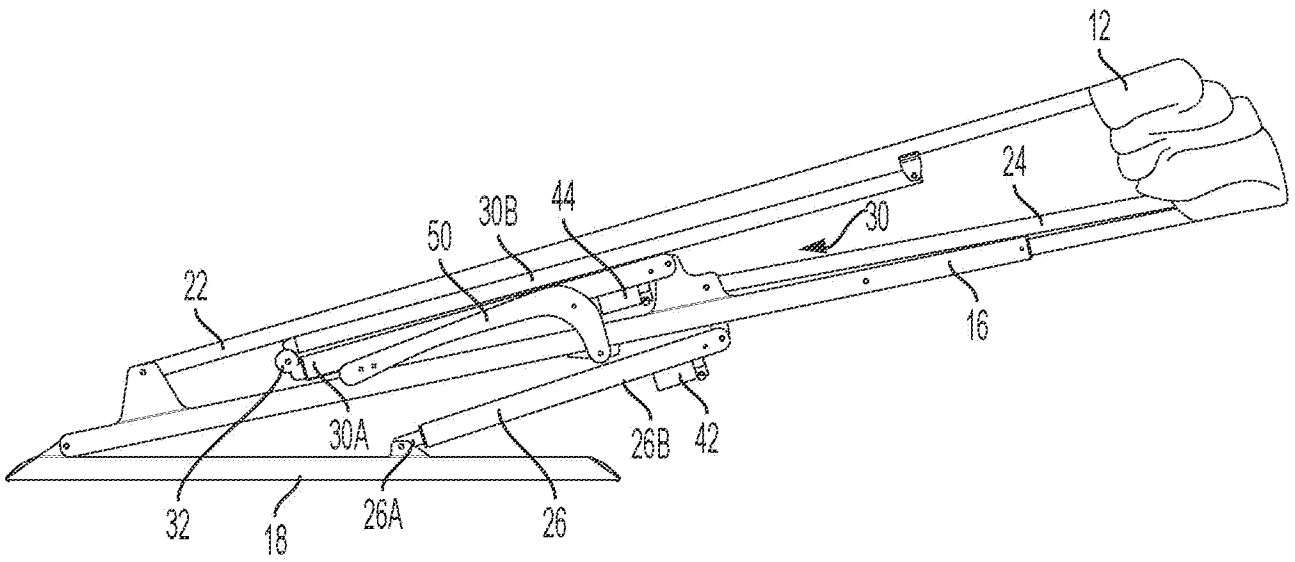
FIG. 15 is a side elevational view of a powered embodiment of a top for a marine vehicle in the stowed position.

In one embodiment, the rear strut 26 is an expandable strut, and in the embodiment seen in FIG. 15, a telescoping strut. The rear actuator 42 is linear rod actuator that is attached to the rear strut 26 to move the rear strut between a first aft or extended position and a second aft or collapsed position. In one embodiment, the rear actuator 42 is attached to the rear strut 26 by being located in a shroud portion 26B of the rear strut. An inner bar portion 26A is slidably received at least partially within the shroud portion 26B. Alternatively, the rear actuator 42 could be attached to the exterior of the rear strut 26.

Figure 16:
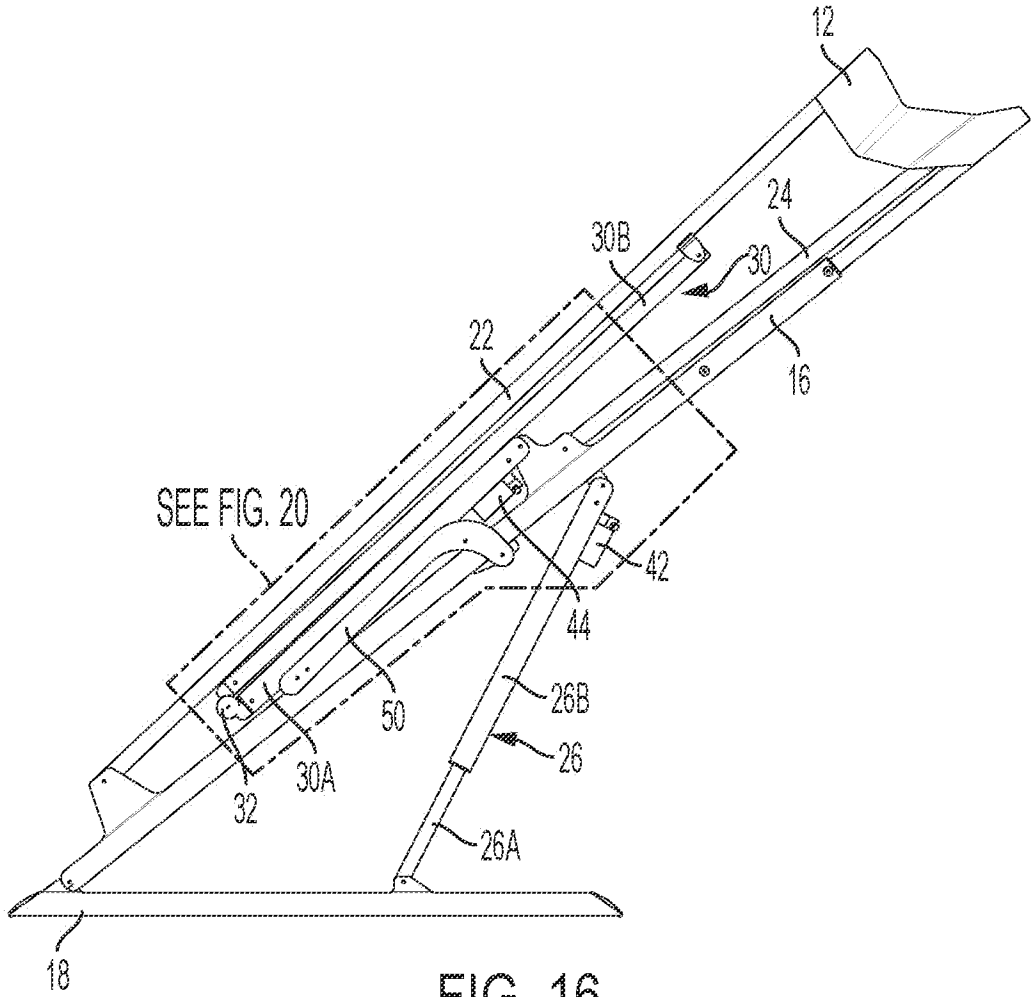
FIG. 16 is a side elevational view of the powered embodiment of a top for a marine vehicle shown in FIG. 15 in the radar position.
Figure 17:
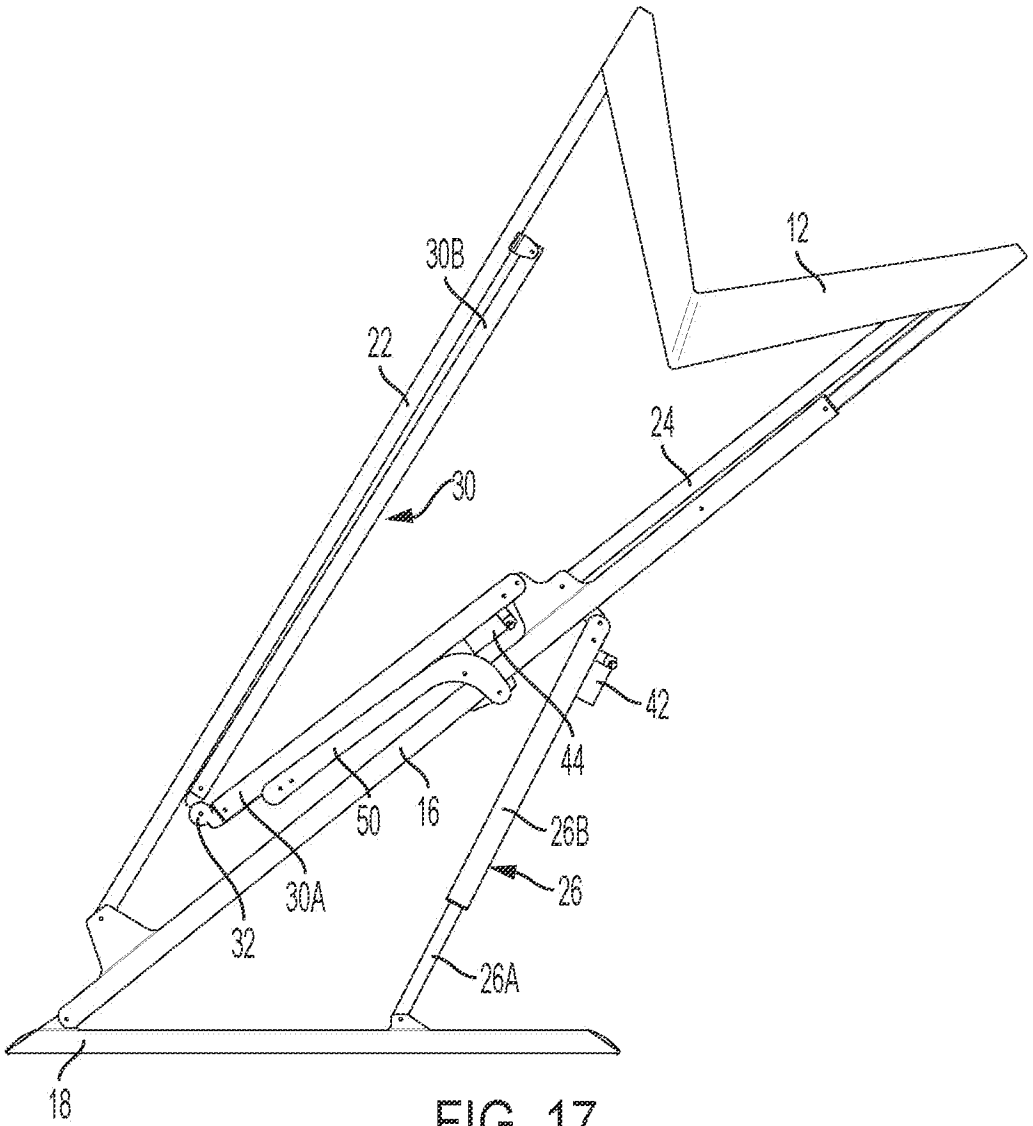
FIG. 17 is a side elevational view of the powered embodiment of a top for a marine vehicle shown in FIG. 15 between the radar position and the deployed position.

In the embodiment seen in FIG. 15, the rod end of the rear actuator 42 is connected to an end of the first or inner bar portion 26A. As the rod end of the actuator 42 is extended from the first position towards the second position, the rod end pushes off of the inner bar portion 26A and the second or shroud portion of 26B is lifted or slid along the inner bar portion. As the shroud portion 26B is lifted, more of the inner bar portion 26A is exposed from the first or shroud portion, and thereby, the frame for the top 10 (e.g. the aft bow 16, forward bow 22, and auxiliary bow 24) is pushed towards the radar position. Once the actuator 42 has moved the shroud portion 26B and, thereby, the rear strut to its desired position, in the embodiment seen in FIG. 16, the first aft or extended position, the rear strut 26 will be expanded, a portion of the frame will be in a raised position. As seen in FIG. 16, the top 10 is in the radar position, in which a portion of the main frame member 16 is remote from the mounting bracket 18. When the rod end of the rear actuator 42 is withdrawn and in the second position, the rear strut 26 will be returned to its second aft or collapsed position in which more of the inner bar portion 26A is within the shroud portion 26B. As seen in FIG. 15, the top 10 is in the stowed position and a portion of the main frame member 16 will be adjacent the mounting bracket 18.

In the embodiment seen in FIG. 15, the forward strut 30 may be an expandable forward strut and also be moved by an actuator, such as second or forward actuator 44, which is a linear rod actuator. The forward actuator 44 can be attached to the forward strut 30, such as, for example, by being located in a first portion 30A of the forward strut 30. Alternatively, the forward actuator 44 could be attached to the exterior of the forward strut 30.

Figure 20A:
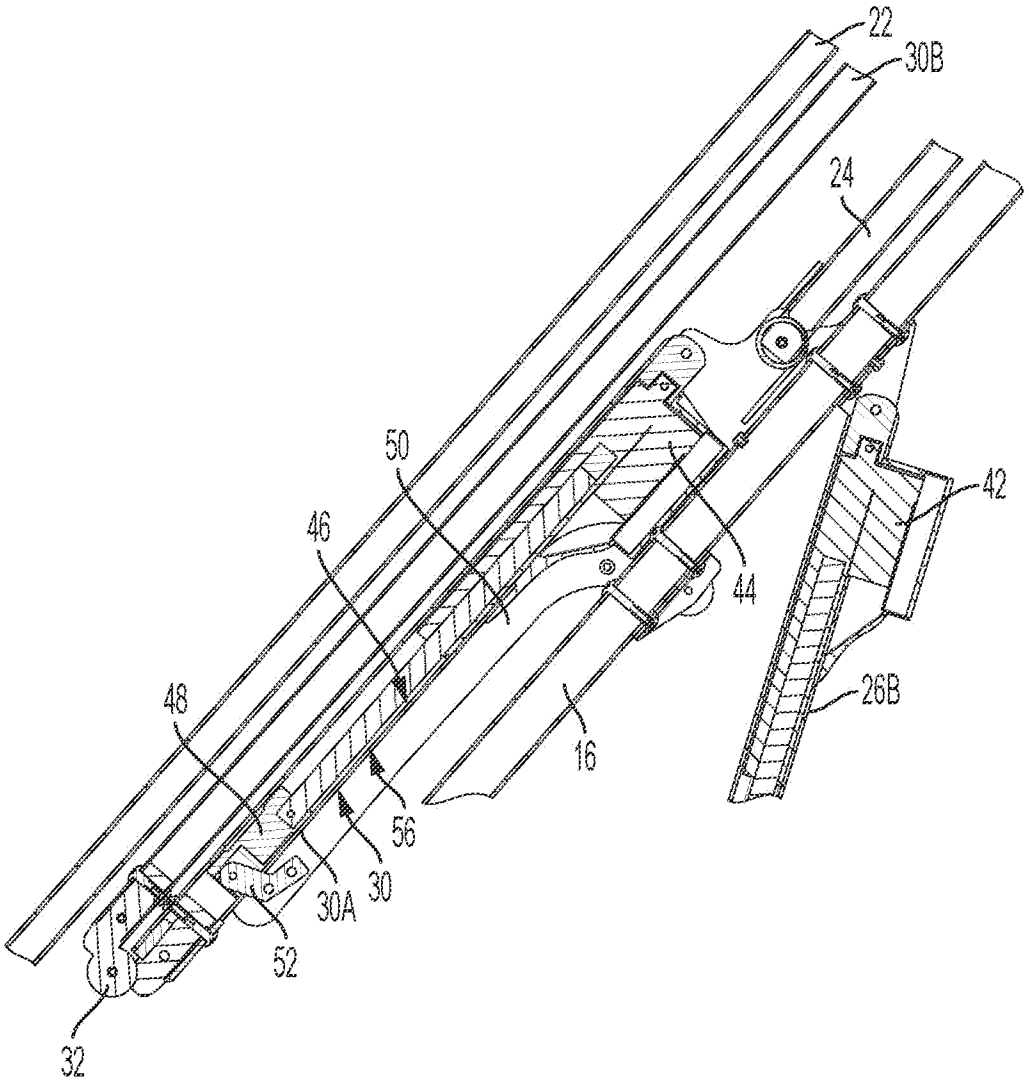
FIG. 20A is a cross-section of a partial side elevational view of the powered embodiment of a top for a marine vehicle shown in FIG. 16.
Figure 20B:
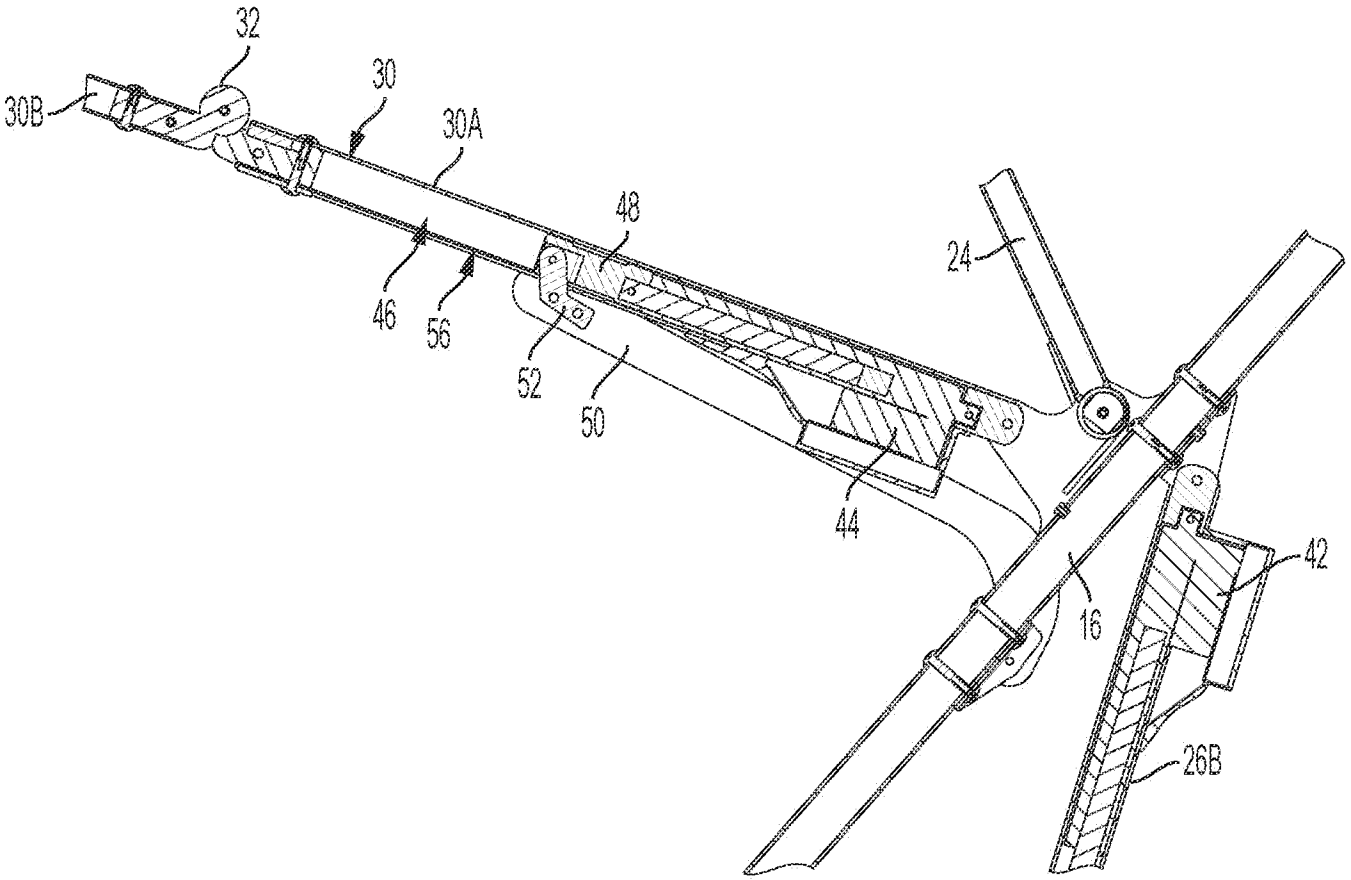
FIG. 20B is a cross-section of a partial side elevational view of the powered embodiment of a top for a marine vehicle shown in FIG. 18.
Figure 21:
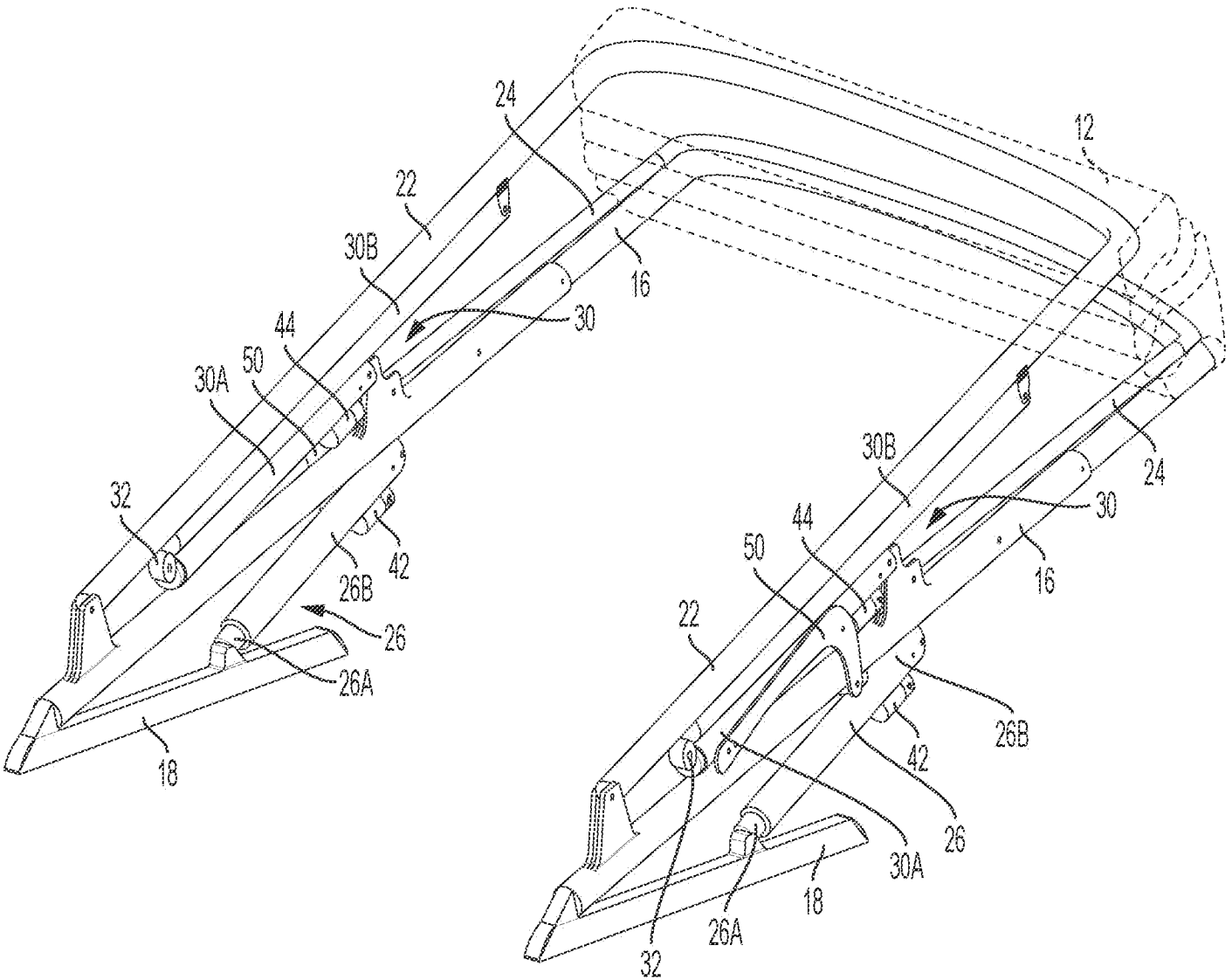
FIG. 21 is a perspective view of the powered embodiment of a top for a marine vehicle shown in FIG. 15.

In one embodiment seen in FIGS. 20A-20B, first portion 30A of the forward strut 30 is a tubular member such that it has a cavity 46. The forward actuator 44 is located at least partially in the cavity 46. The rod end of the forward actuator 44 is connected to a carriage 48 that is slidably attached to the forward strut 30. In one embodiment, the carriage 48 is sized to fit within the cavity and move along the first portion 30A of the forward strut 30. As the rod end of the forward actuator 44 extends from the first position to the second position, the carriage 48 is moved towards the hinge 32.

In order to cause the movement of the carriage 48 to result in the expanding or unfolding of the forward strut 30, a strut link 50 is used. In the embodiment seen in FIG. 15, the strut link is curved or "L" shaped. A first end of the strut link 50 is rotatably attached to the aft bow 16, e.g. a leg portion, and a second end of the strut link is attached to the forward strut 30. In the embodiment seen in FIGS. 20A-20B, the second end of the strut link 50 is attached to the carriage 48. In one embodiment, the second end of the strut link 50 is attached to a carriage link 52. The carriage link 52 has a tongue 54 that extends through a slot 56 in the bottom of the aft bow 16 and is received within a slot of the carriage 48. A fastener, such as a pin, rivet, etc., connects the carriage link 52 to the carriage 48. Other means are known for attaching a link to a bow, such as by integrally forming the carriage 48 and the carriage link 52, by having the second end of the link 50 extend through the slot 56 and into the cavity 46, and/or by having a slidable pin attach the strut link to the aft bow. The forward actuator 44 moves the carriage 48 between a first carriage position a first distance from the hinge 32 (as seen in FIG. 20A) to a second carriage position a second distance from the hinge (as seen in FIG. 20B) as the forward strut 30 is moved from a collapsed position to an extended position. The second distance is greater than the first distance.

In one embodiment, the rod end of the forward actuator 44 is extended when the top 10 is the radar position as well as in the stowed position. As the rod end of the forward actuator 44 is retracted or withdrawn from the first position (FIG. 20A) towards the second position (FIG. 20B), and the carriage 48 is moved from the first carriage position, towards a second carriage position and the strut link 50 begins to rotate clockwise (from the perspective seen in FIGS. 16-18). The strut link 50 transfers the linear force from the rod end of the forward actuator 44 acting on the second end of the strut link to a moment about the first end of the strut link to push the first portion 30A of the forward strut 30 away from the aft bow 16 and, thereby, pushing the second portion 30B of the forward strut 30 and the forward bow 22 away from the aft bow. As the rod end of the forward actuator 44 continues to retract, and the carriage 48 continues to move towards the second carriage position and the second portion 30B of the forward strut 30 begins to rotate about the hinge 32.

Figure 18:
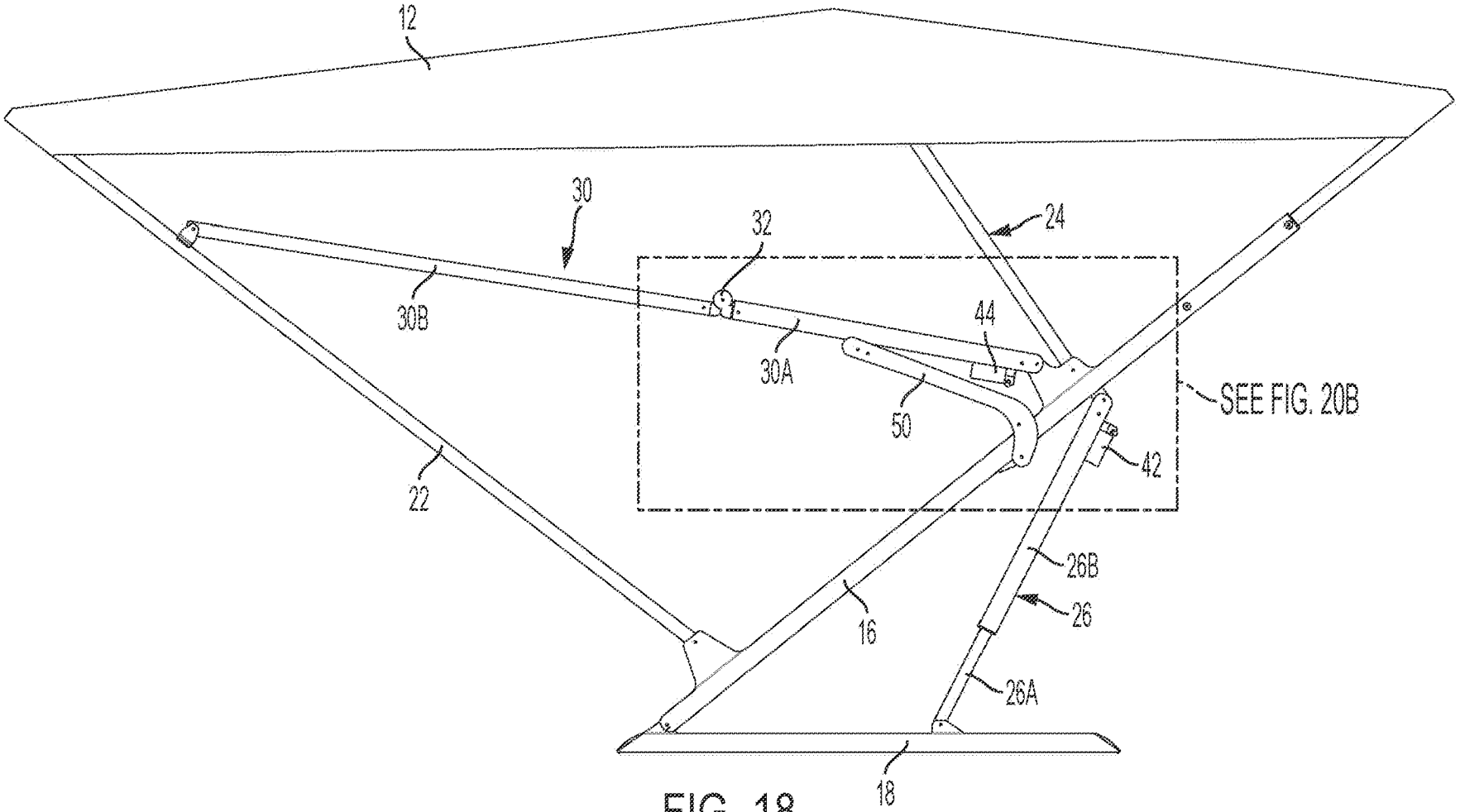
FIG. 18 is a side elevational view of the powered embodiment of a top for a marine vehicle shown in FIG. 15 in the deployed position.
Figure 25:
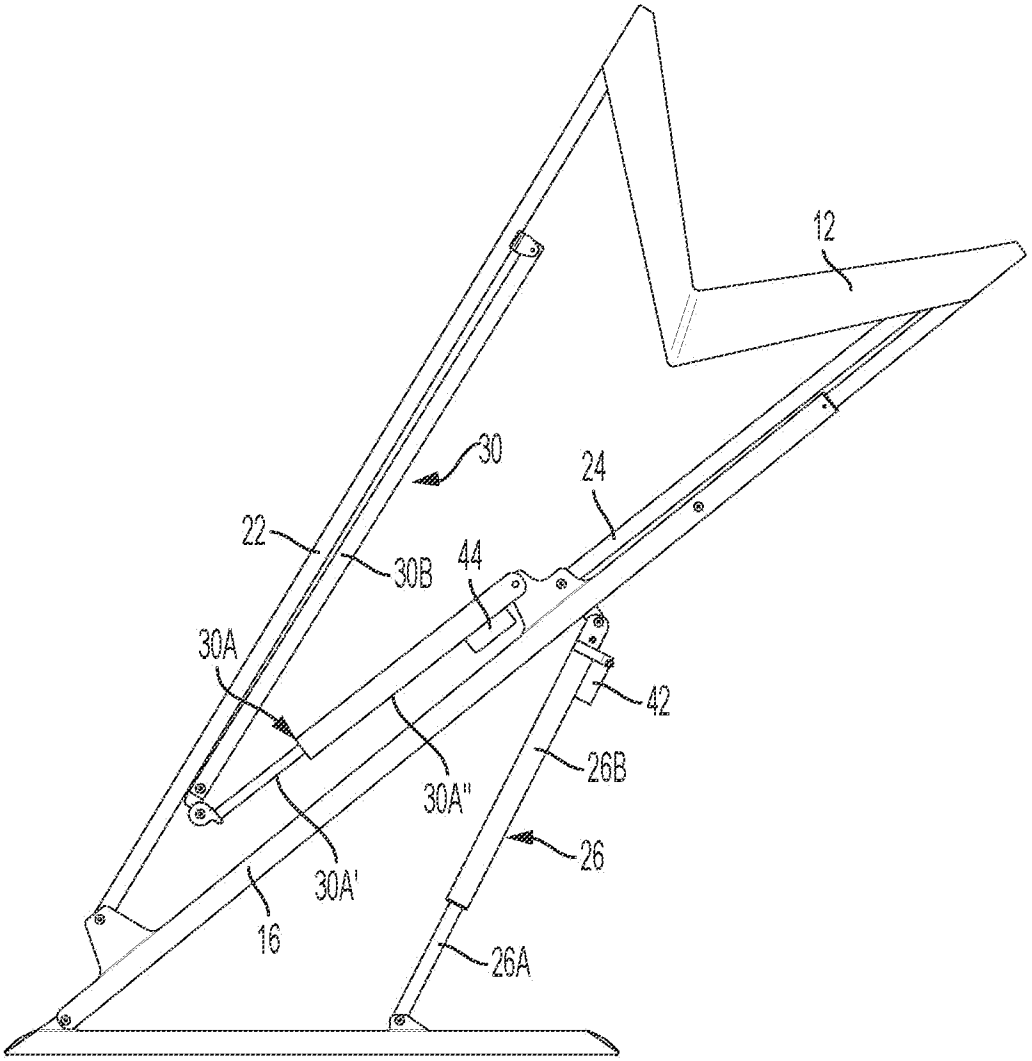
FIG. 25 is a side elevational view of another alternative powered embodiment of a top for a marine vehicle between the radar position and the deployed position.
Figure 26:
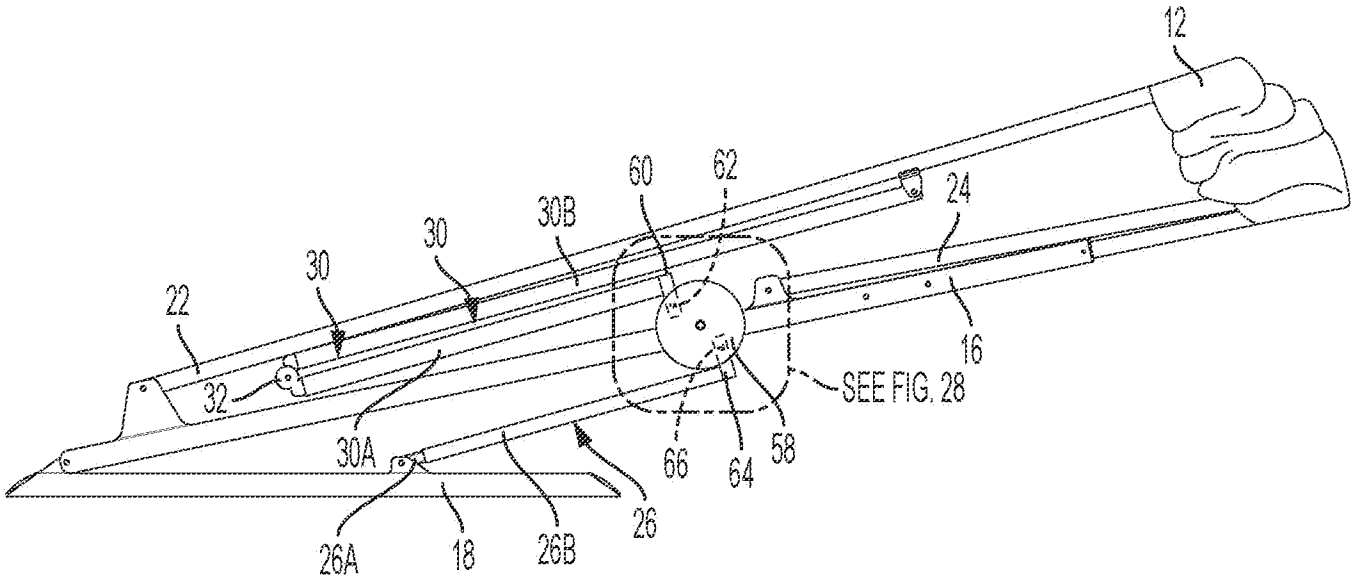
FIG. 26 is a side elevational view of another alternative powered embodiment of a top for a marine vehicle in the stowed position.

When the rod end of the forward actuator 44 is in the second position and the carriage 48 is in the second carriage position, the second portion 30B is generally inline with the first portion 30A of the forward strut 30 and the forward strut expanded as seen in FIG. 18. When the forward strut 30 is generally expanded, the forwards strut is in a first forward or extended position and a portion of the secondary frame member 22 will be remote from the main frame member 16. And if the rear strut 26 is in its extended position, the top will be in the first or deployed position as seen in FIG. 18. As the rod end of the forward actuator 44 extends, the carriage will move towards the first carriage position until the forward strut 30 is in the second forward or collapsed position as seen in FIG. 16. In this position, the secondary frame member 22 is generally adjacent the main frame member 16. And, if the rear strut 26 is in its collapsed position, the top will be in the second or stowed position as seen in FIG. 15. The powered embodiments of the frame for the top 12 could also include a rear brace 34 and/or a forward brace 36, as described in other embodiments above and seen in FIG. 25.

Figure 19:
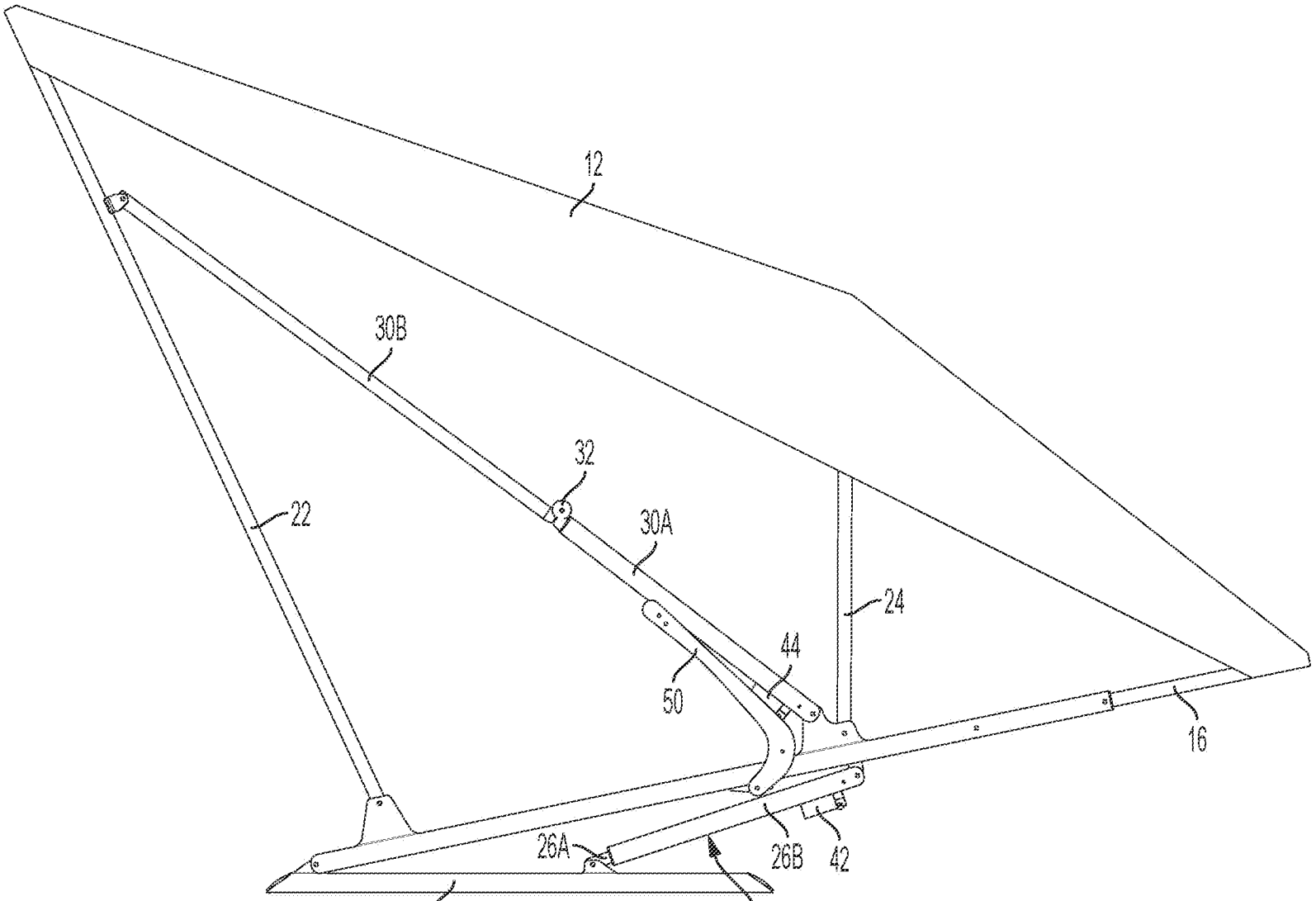
FIG. 19 is a side elevational view of the powered embodiment of a top for a marine vehicle shown in FIG. 15 in the shade position.

In one embodiment, a first activation of the top, e.g. flipping of a switch, could result in the top 10 moving from a stowed position to a deployed position. A second activation, e.g. moving the switch in a different direction or pushing of a different button, could result in the top moving from a deployed position to a stowed position. In moving between the stowed position and deployed position, the rear actuator 42 and forward actuator 44 could operate at the same time resulting in shorter time between positions. Alternatively, one actuator could operate fully before second actuator begins to operate. Or, one actuator could begin to operate, but not complete its operation, before second actuator begins to operate. Additionally, or alternatively, one type of activation of the top could result in only one actuator operating. For example, if it is desirable to have shade from a setting or rising sun, the forward actuator 44 could move the forward strut 30 to its expanded position as seen in FIG. 19. Operation of the top 10 could also be selectable such that the top could be stopped midway at any point during operation when the top is in the desirable position.

Figure 22:
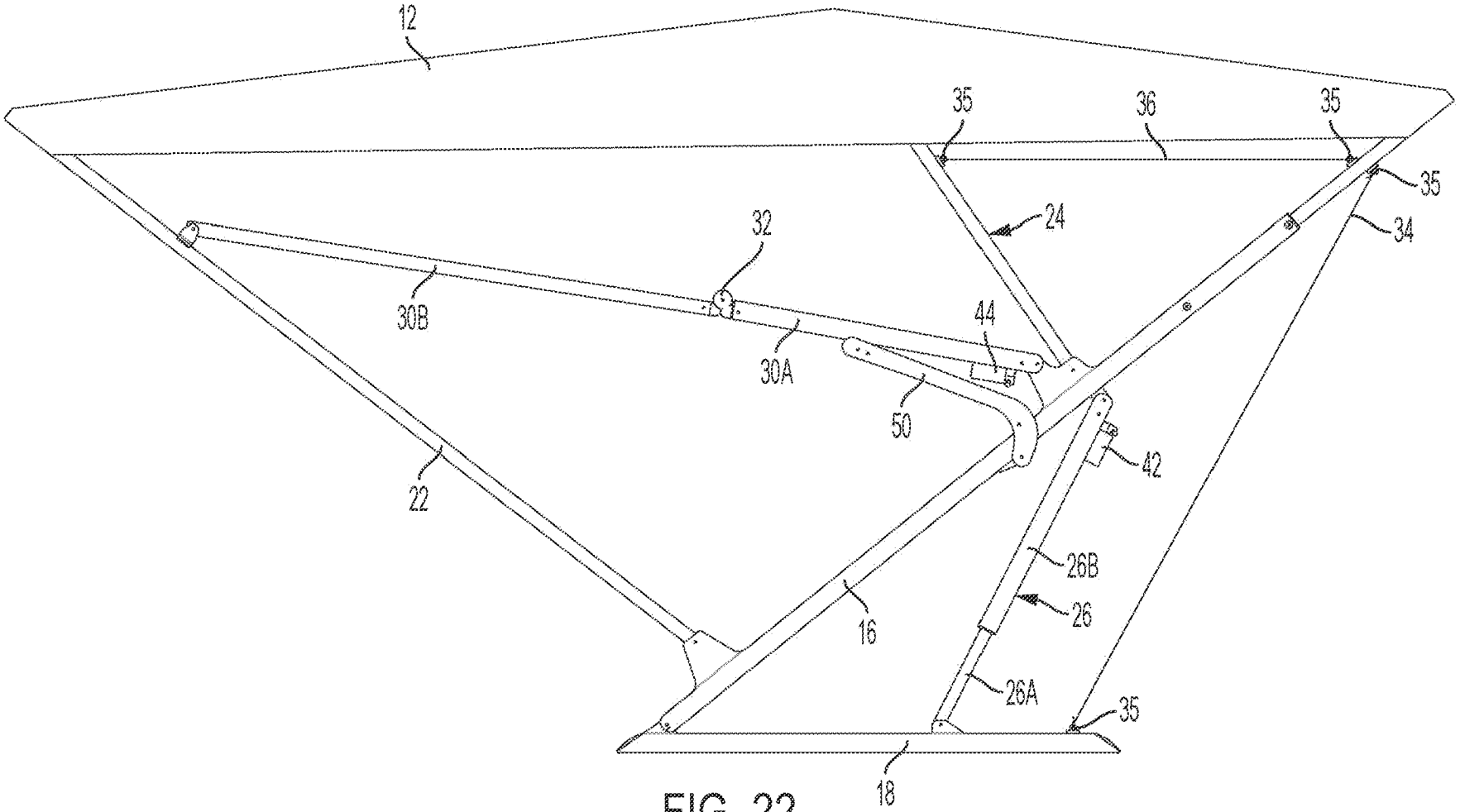
FIG. 22 is a side elevational view of an alternative powered embodiment of a top for a marine vehicle in the stowed position.
Figure 23:
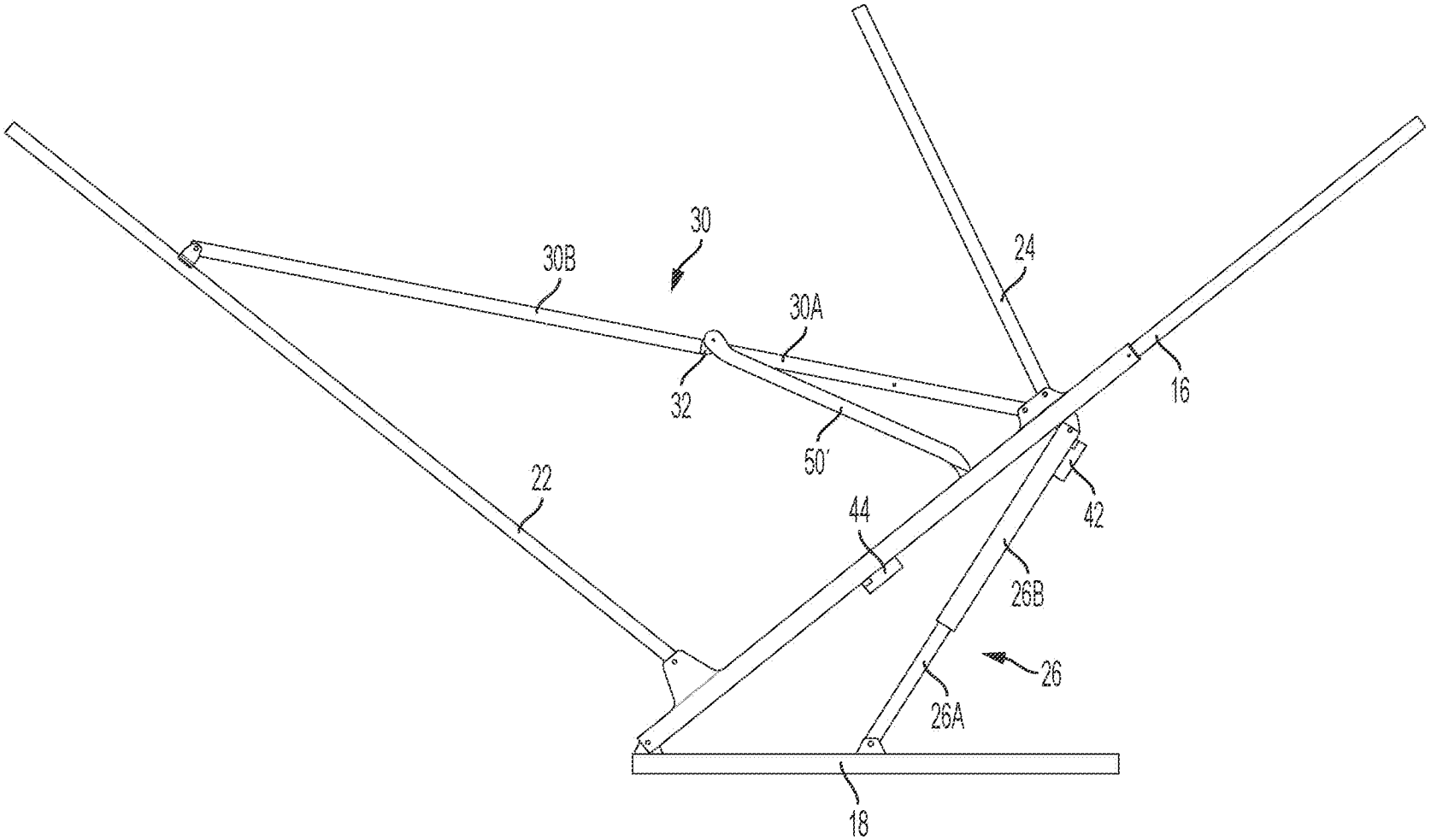
FIG. 23 is a side elevational view of the powered embodiment of a top for a marine vehicle shown in FIG. 22 in the deployed position.

In another alternative embodiment, seen in FIGS. 22-23, The carriage 48 and forward actuator 44 could be attached to, or even located in, the main bow 16. In this embodiment, one end of the strut link 50' is pivotally attached to the hinge 32 and the other end is attached to a carriage (not shown). When the top 10 is in the collapsed position, as seen in FIG. 22, the forward actuator 44 is in an extend position and the forward strut is folded at the hinge.

As the rod end of the forward actuator 44 is retracted, and the carriage moves (and thereby, the first end of the strut link 50' moves), from a first carriage position (seen in FIG. 22) towards a second carriage position (seen in FIG. 23) along the main frame member 16. As the carriage moves, the strut link 50' begins to rotate clockwise (from the perspective seen in FIG. 22) transferring the force from rod end of the forward actuator 44 on one end of the strut link 50' to a moment about the other end of the strut link to push the first portion 30A of the forward strut 30 away from the aft bow 16 and, thereby, pushing the second portion 30B of the forward strut 30 and the forward bow 22 away from the aft bow. As the rod end of the forward actuator 44 continues to retract, and the carriage continues to move towards the second carriage position, the second portion 30B of the forward strut 30 begins to rotate about the hinge 32. When the second portion 30B is generally in line with the first portion 30A of the forward strut 30, the carriage will be in the second carriage position. And, if the rear strut 26 is in the extended position, the top will be in the deployed position as seen in FIG. 23.

Figure 24:
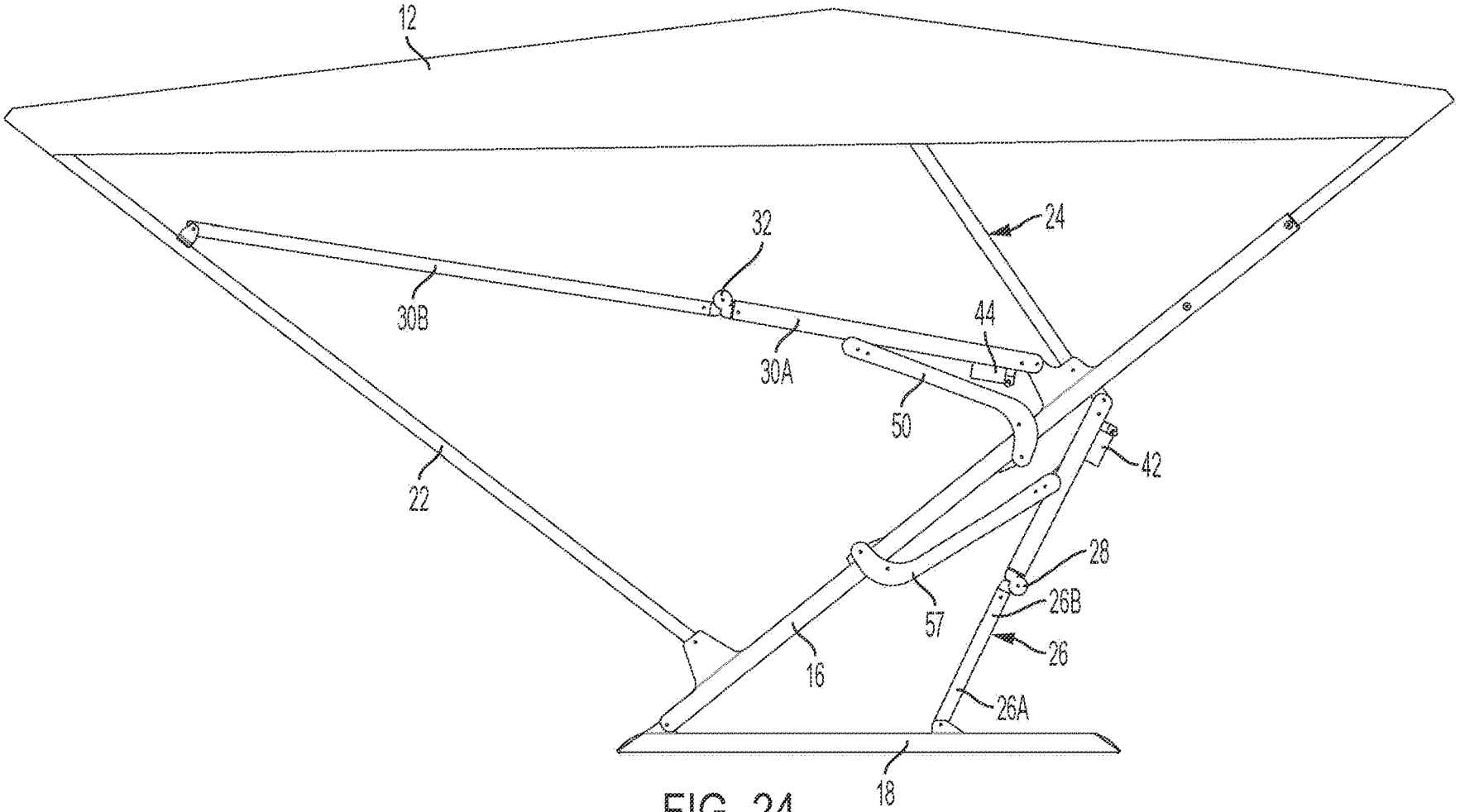
FIG. 24 is a side elevational view of another alternative powered embodiment of a top for a marine vehicle in the deployed position.

In another embodiment, seen in FIG. 24, a second strut link 57 could be used in connection with the rear strut 26 similar to that described above with respect to the strut link 50 used in connection with the forward strut 30. The second strut link 57 has a first end attached to the main frame member 16 and a second end attached to the rear strut 26. As the rod end of the rear actuator 44 is retracted, a second carriage (not shown) moves and the second strut link 57 begins to rotate clockwise (from the perspective seen in FIG. 24) transferring the force from rod end of the rear actuator 42 to push the second portion 26B of the rear strut 26 away from the aft bow 16 and, thereby, causing the first portion 26A of the rear strut to rotate away from the aft bow.

Figure 27:
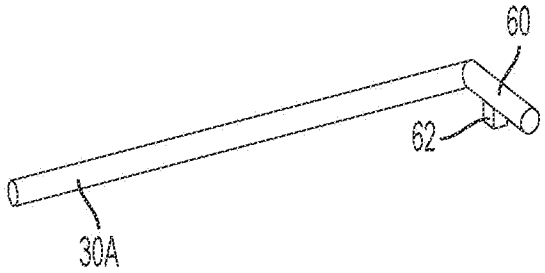
FIG. 27 is a perspective view of a portion of the forward strut from FIG. 26.

In another alternative embodiment seen in FIGS. 26-31, the shroud portion 26B of the rear strut 26 and the first portion 30A of the forward strut 30 are both attached to a centralized hub 58. In one embodiment, the centralized hub operates like a cam and follower. As seen in FIG. 27, the end of the shroud portion 26B of the rear strut 26 could have a structural member, such as a rear arm 60, that extends to the centralized hub 58. The rear arm 60 may also have a rear finger 62 that attaches the rear strut 26 to the centralized hub 58. The end of the first portion 30A of the forward strut 30 could also have a structural member, such as a forward arm 64, that extends to the centralized hub 58. The forward arm 64 may also have a forward finger 66 that attaches the forward strut 30 to the centralized hub.

Figure 28:
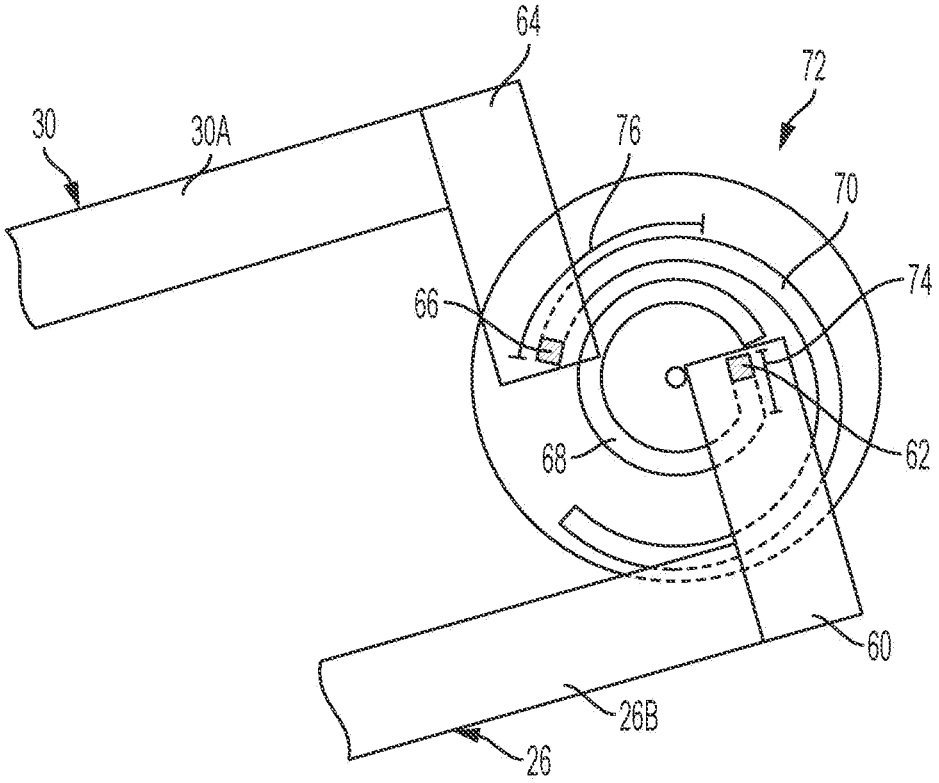
FIG. 28 is a partial side elevational view of the cam from FIG. 27 when the top is in the stowed position.
Figure 29:
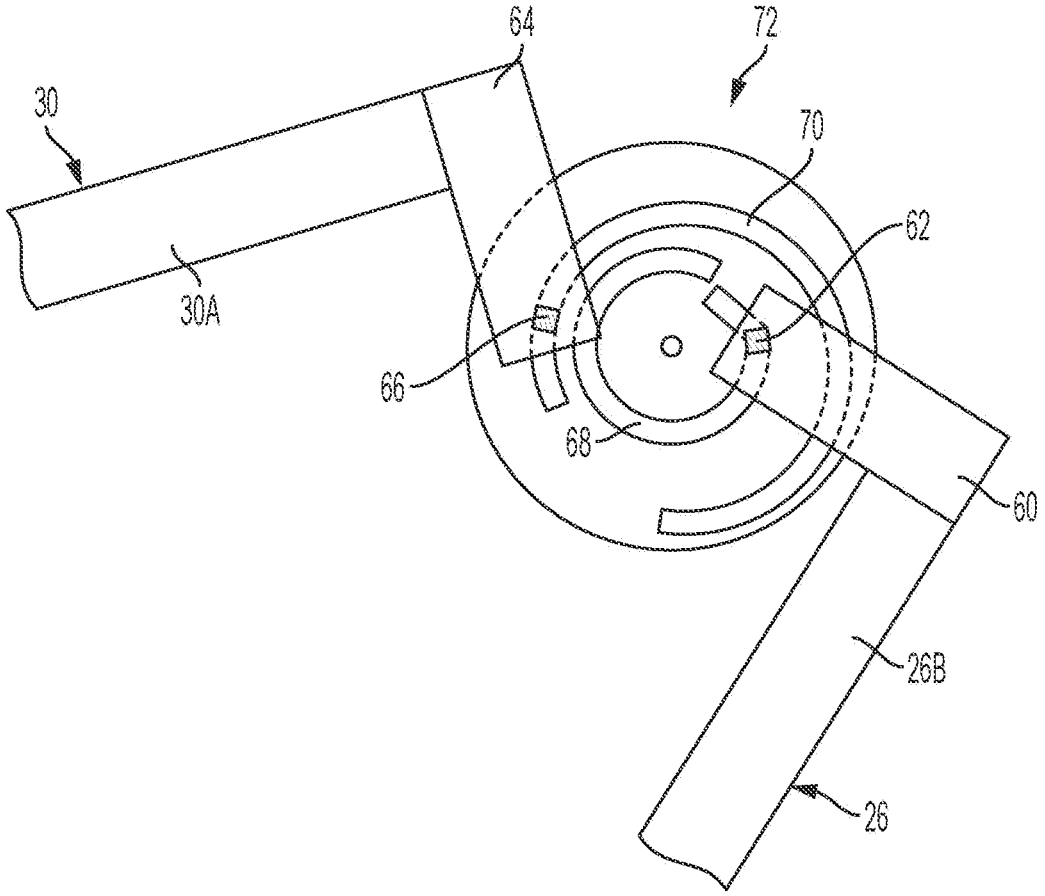
FIG. 29 is a partial side elevational view of the cam when the top is in the radar position.
Figure 30:
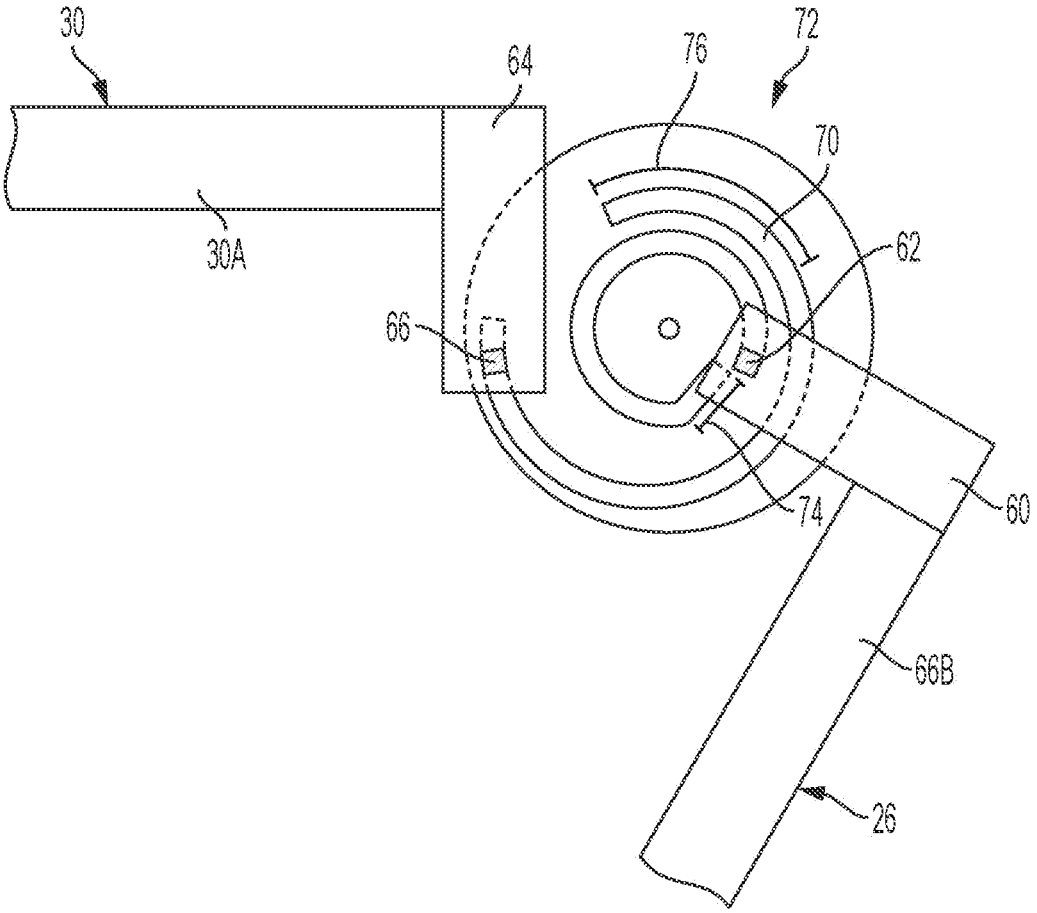
FIG. 30 is a partial side elevational view of the cam when the top is in the deployed position.

As seen in FIGS. 28-30, the centralized hub 58 can have a cam 72 with paths configured to be engaged and followed by the fingers 62, 66. In one embodiment, the centralized hub 58 has a first groove 68 and a second groove 70. The rear finger 62 engages the first groove 68 and the forward finger 66 engages the second groove 70. As the cam 72 rotates, the fingers 62, 66 rotate within the grooves 68, 70 thereby rotating the arms 60, 64 and the struts 26, 30.

The grooves 68, 70 can be eccentric to cause the arms 60, 64 and, thereby, the rear strut 26 and forward strut 30 to rotate. For example, in one embodiment, the first groove 68 has a drop 74 at the beginning. As the cam 72 rotates, counterclockwise in the orientation seen in FIG. 28, the rear finger 62 follows the drop 74 and the rear arm 60 rotates counterclockwise, which causes the shroud portion 26B to rotate counterclockwise to extend the rear strut 26, which can be seen by comparing FIGS. 28 and 29. Because the beginning portion 76 of the second groove 70 is not eccentric, e.g. maintains a generally continuous radius, as the forward finger 66 moves through the second groove, the forward arm 64 is not rotated.

Figure 31:
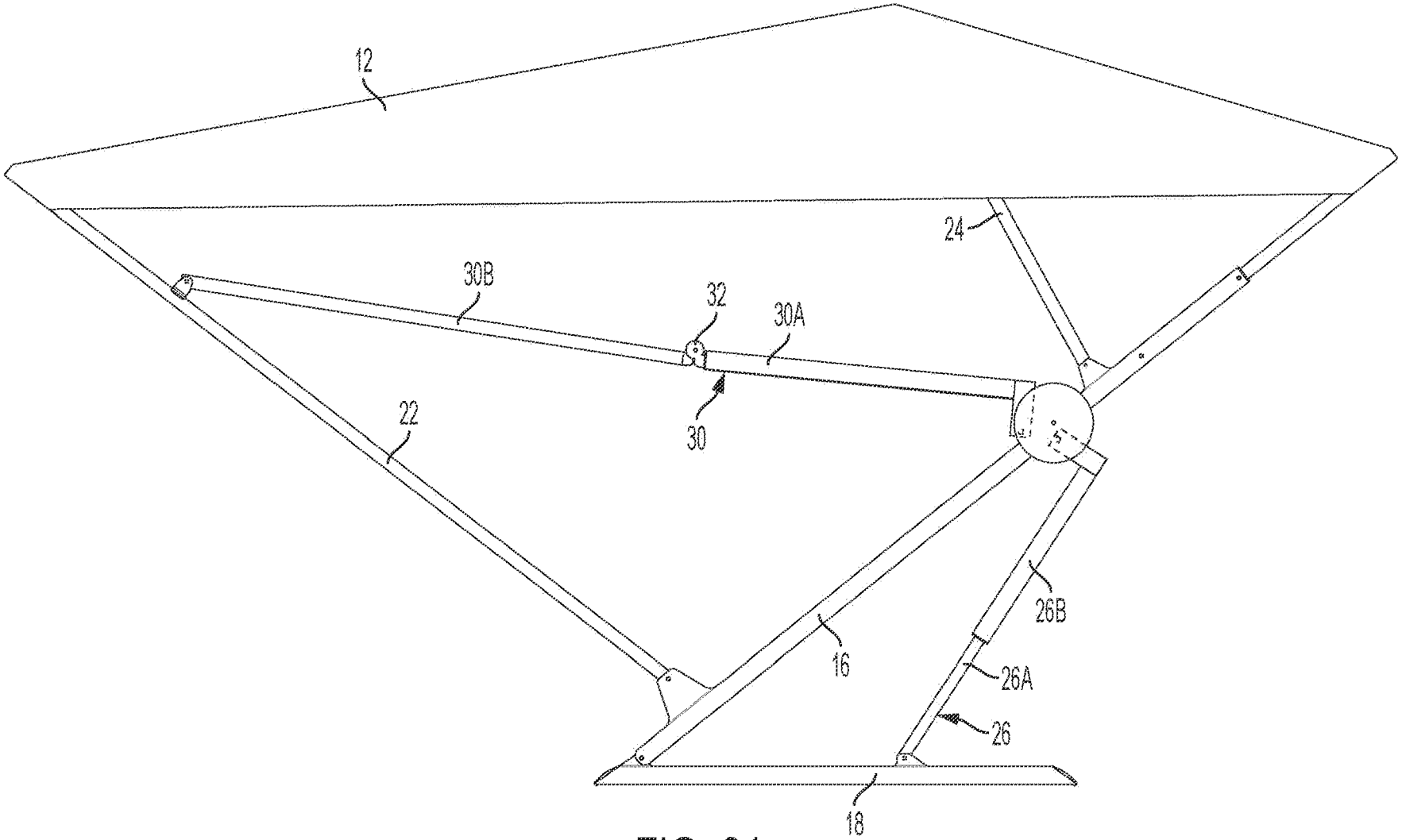
FIG. 31 is a side elevational view of the top from FIG. 27 when the top is in the deployed position.

As seen in FIG. 30, after the drop 74, the ending portion 78 of the first groove 68 is not eccentric, e.g. maintains a generally continuous radius, so that the rear strut 26 is not rotated further. The ending portion 80 of the second groove 70 becomes eccentric and the radius gradually increases. As the cam 72 continues to rotate, the second finger 62 follows the ending portion 80 of the second groove 70 which causes the forward arm 64 to rotate clockwise and, thereby, the first portion 30A of the forward strut 30 to rotate. As the cam 72 continues to rotate, the first portion 30A continues to rotate until the forward strut 30 unfolds and is in the extend position as seen in FIG. 31. The position of the fingers 62, 66 in the grooves 68, 70 when the top 10 is in the deployed position, can been seen in FIG. 30.

The grooves 68, 70 could be shaped and sized to accommodate different rotating patterns. For example, the second groove 70 could begin increasing in radius right from the start such that the forward strut 30 starts to rotate together with the rear strut 26. Alternatively, the grooves 68, 70 could be located on opposite sides of the cam 72 or on different cams or the exterior surface of the cam could be shaped accordingly and the fingers 62, 66 could ride on the exterior surface of the cam without defeating the spirit of the embodiment.

Figure 32:
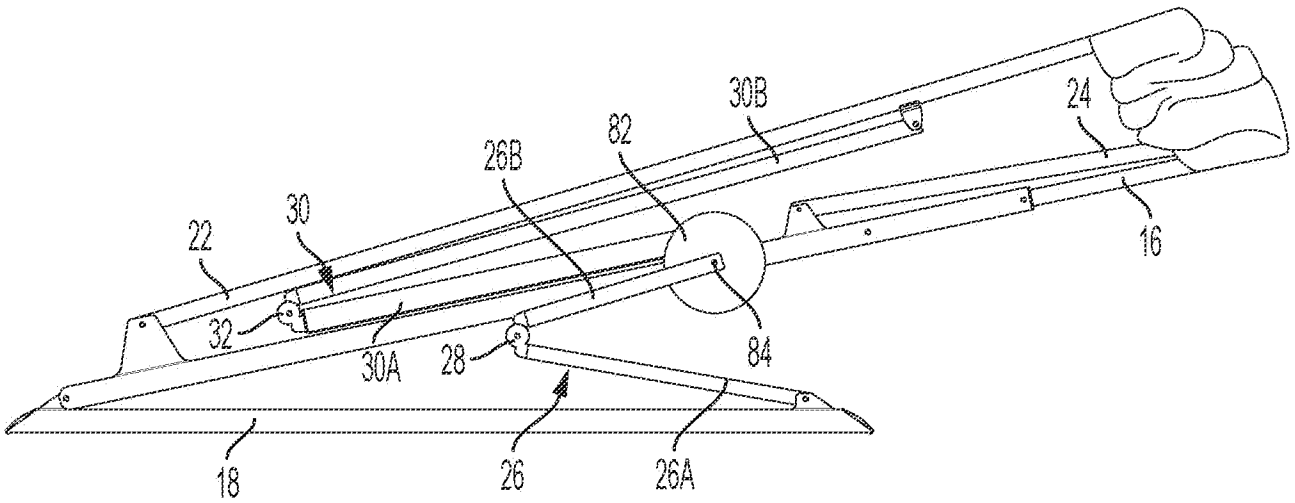
FIG. 32 is a side elevational view of another alternative powered embodiment of a top for a marine vehicle in the collapsed position.
Figure 33:
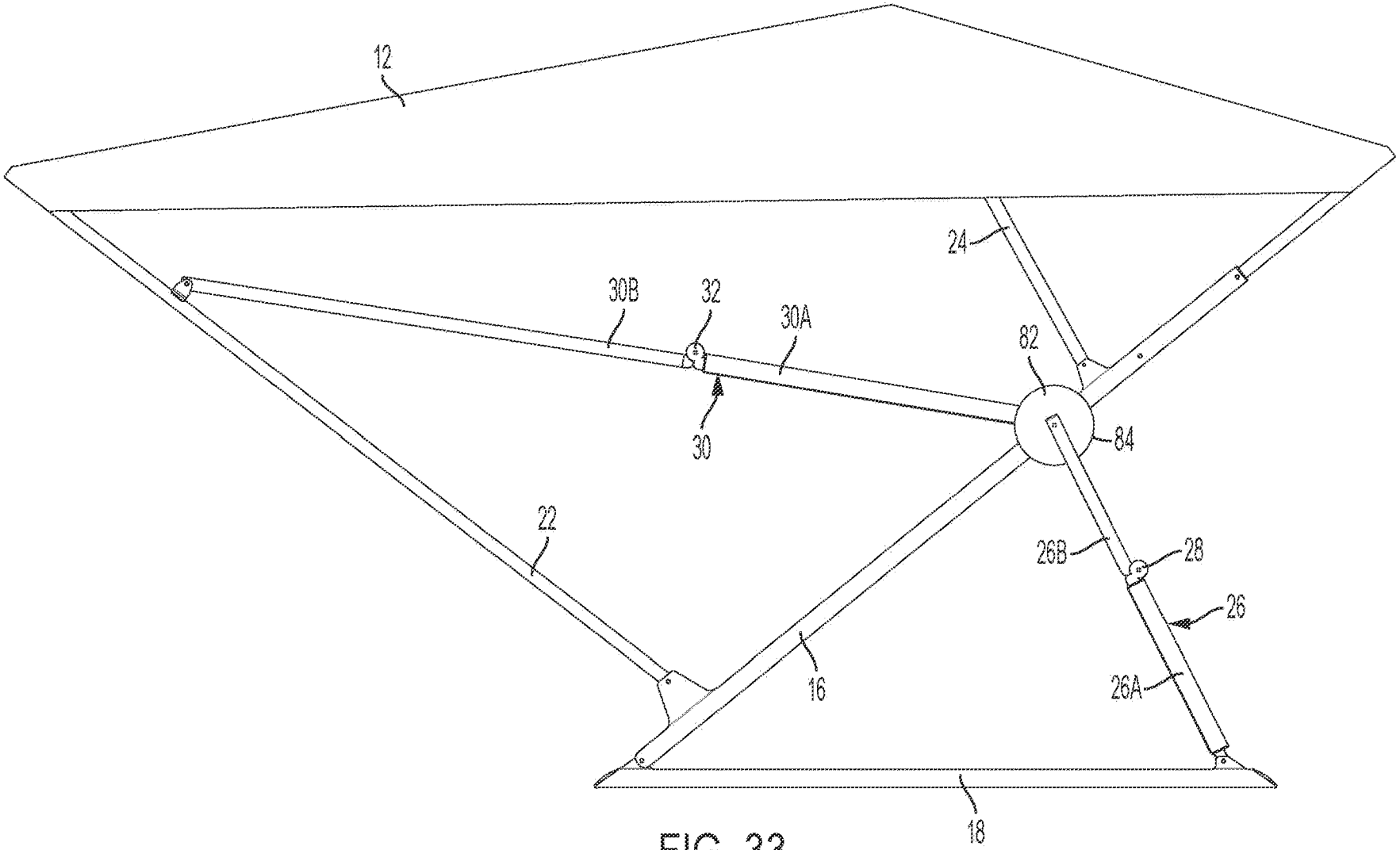
FIG. 33 is a side elevational view of the top from FIG. 32 when the top is in the deployed position.

In another embodiment, the forward strut 30 and/or rear strut 26 could be rotated by a cycloidal gear box 82. In one such embodiment seen in FIGS. 32-33, the second portion 26B of the rear strut 26 is attached to a first shaft 84 of the cycloidal gear box 82 located on a first side of the cycloidal gear box. The first portion 30A of the forward strut 30 is attached to a second shaft (not shown) of the cycloidal gear box 82 located on a second side of the cycloidal gear box. Because the cycloidal gear box 82 can rotate the first shaft in a first direction and the second shaft in a second direction, which is opposite the first direction, the first shaft can be rotated counterclockwise (in the orientation seen in FIGS. 32-33) and the second shaft can be rotated clockwise to move the top 10 from the collapsed position (FIG. 32) to the deployed position (FIG. 33).

Figure 34:
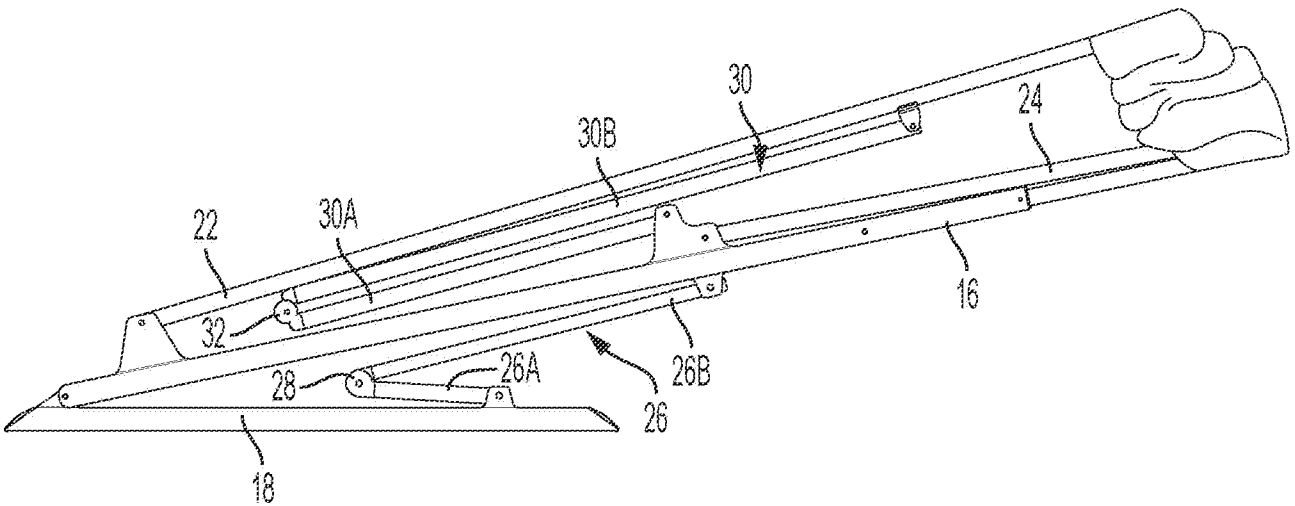
FIG. 34 is a side elevational view of another alternative powered embodiment of a top for a marine vehicle in the collapsed position.

In one embodiment seen in FIG. 34, upon activation, for example, pressing a button or flipping a switch, with the top 10 in the stowed position, the first hinge 28 will be activated, thereby, opening, extending and/or straightening the rear strut 26 and pushing the remainder of the top to an intermediate or radar position. In this position, the main frame member 16 is in the deployed position. Upon some event, for example an amount of time the hinge is activated or a sensor sending a signal such as upon sensing an amount the hinge has rotated, the first hinge 28 is deactivated and held and/or locked in position.

Then, the second hinge 32 is activated pushing the remainder of the top 10 into the deployed position. For example, the secondary frame member 22 is rotated away from the main frame member 16. Upon some event, the second hinge 32 is deactivated and held and/or locked in position to hold the top 10 in the deployed position. The rotation of the secondary frame member 22, causes the covering 12 to expand. The expansion of the covering pulls the auxiliary bow 24 causing it to rotate away from the main frame member 16 and into the deployed position. To move the top 10 from the deployed position to the stowed position the button could be pressed again or the switch flipped in a different direction to cause the top to work in the reverse order.

Alternatively, upon pressing a button or flipping a switch, both hinges 28, 32 could be activated together to cause to the top to be moved in a shorter time period. Another alternative embodiment includes the first activation of the button or switch causing the top to move to the radar position from either the stowed or the deployed position and a second activation of the button or switch causing the top to move to the deployed position or radar position, respectively.

Figure 35:
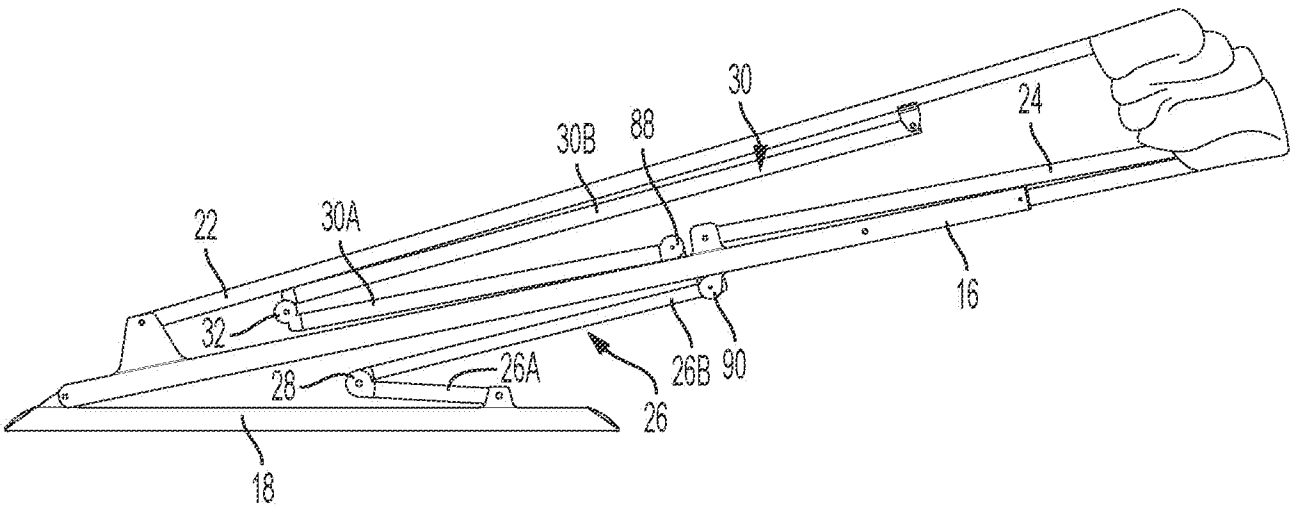
FIG. 35 is a side elevational view of another alternative powered embodiment of a top for a marine vehicle in the collapsed position.

Any number of powered hinges could be used without defeating the spirit of the invention. Although a two powered hinge embodiment is described above, a single powered hinge could be used to move the top 10 from the stowed position to the radar position or from the radar position to the deployed position. By way of another example, four powered hinges could be used as seen in FIG. 35. In addition to the powered hinges 28, 32 described above, the rear strut 30 and the forward strut 30 could each be attached to the main frame member 16 by a powered hinge 88, 90.

Figure 36:
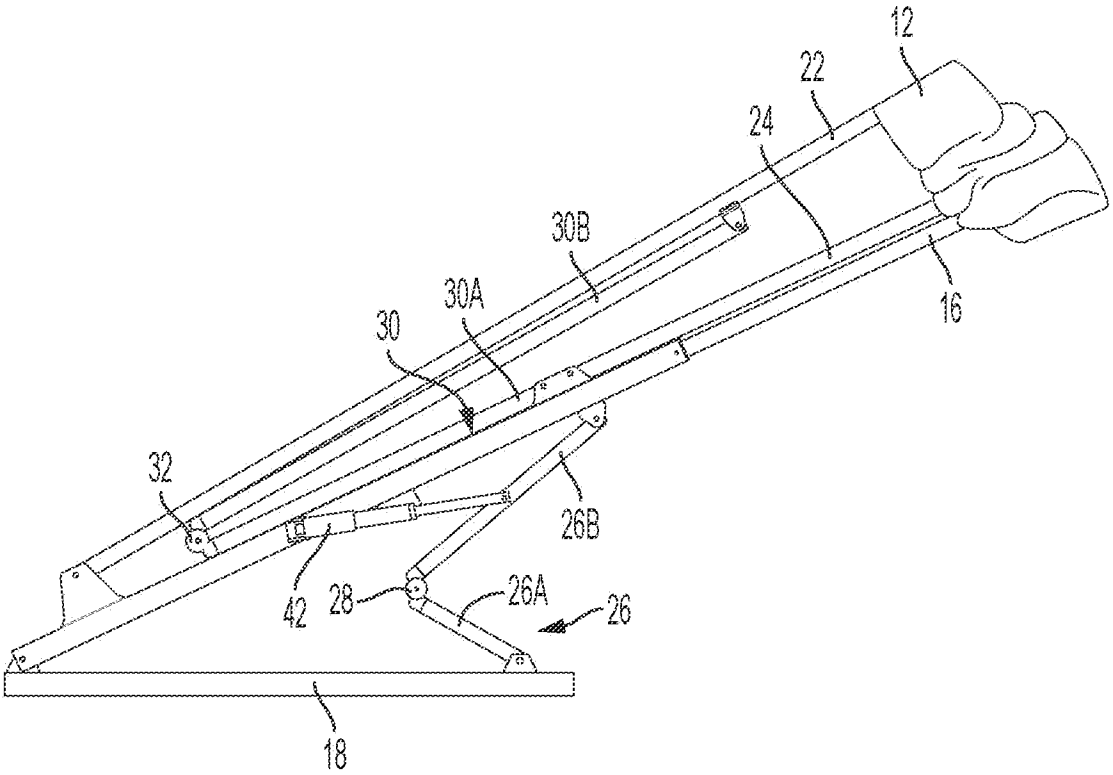
FIG. 36 is a side elevational view of another alternative powered embodiment of a top for a marine vehicle between the collapsed position and the radar position.

In yet another embodiment, the rear actuator 42 could be attached to the main bow 16 as seen in FIG. 36. In this embodiment, the rear actuator 42 has a first end pivotally attached to the main bow 16 and a second end pivotally attached to the rear strut 26. As the rod end of the rear actuator 42 is extended, the main bow 16, as well as the forward strut 30 and forward bow 22 connected thereto, will begin to move towards the radar position and the first portion 26A and second portion 26B of the rear strut 26 will begin to rotate about the rear hinge 28. As the rod end of the rear actuator 42 continues to extend, the first portion 26A and second portion 26B of the rear strut 26 will continue to rotate until they reach the radar position as previously described in other embodiments.

Figure 37:
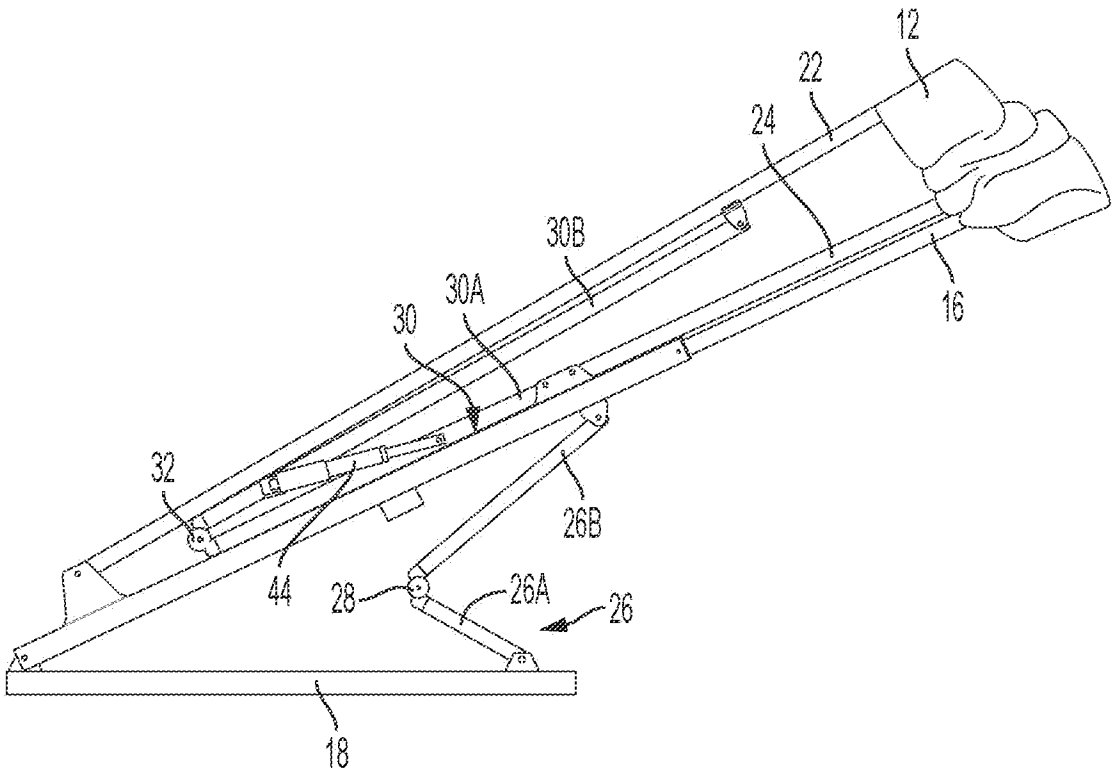
FIG. 37 is a side elevational view of another alternative powered embodiment of a top for a marine vehicle between the collapsed position and the radar position.

In yet another embodiment, the forward actuator 44 could be attached to the forward strut 30 as seen in FIG. 37. In this embodiment, the forward actuator 44 has a first end pivotally attached to the first portion 30A of the forward strut 30 and a second end pivotally attached to the main bow 16. As the rod end of the forward actuator 44 is extended, the forward bow 22 will begin to move towards the deployed position and the first portion 30A and second portion 30B of the forward strut 30 will begin to rotate about the forward hinge 32. As the rod end of the forward actuator 44 continues to extend, the first portion 30A and second portion 30B of the forward strut 30 will continue to rotate until they reach the deployed position as previously described in other embodiments.

Figure 38:
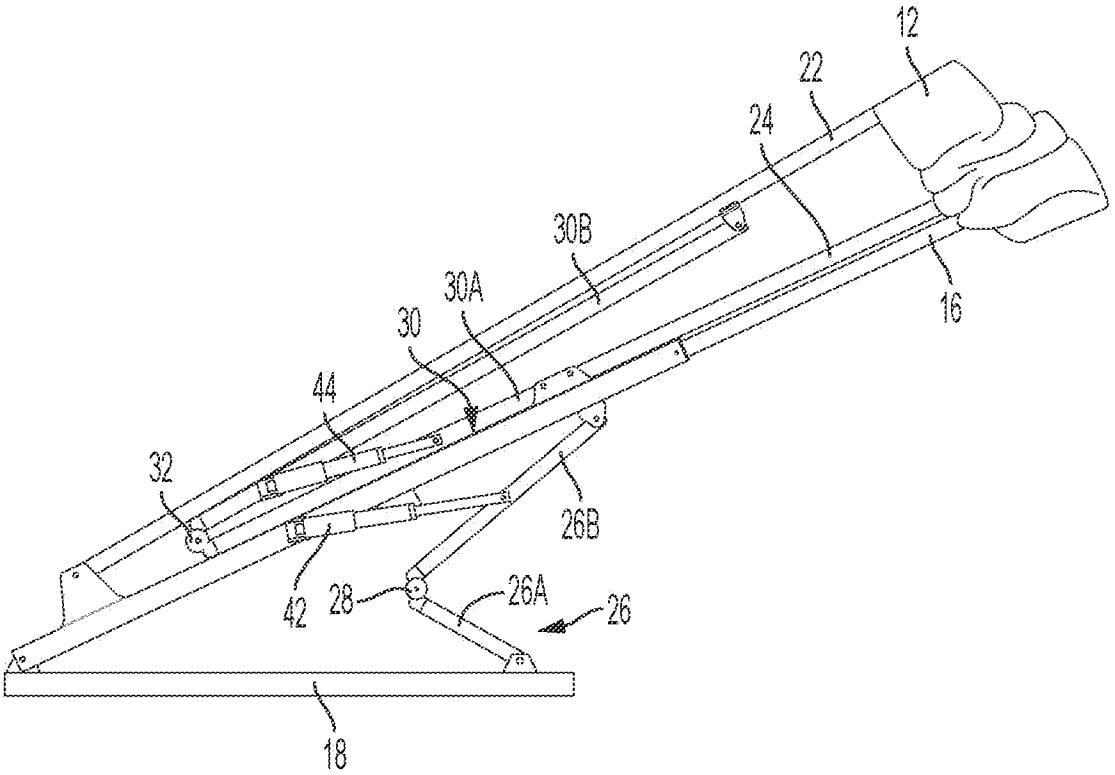
FIG. 38 is a side elevational view of another alternative powered embodiment of a top for a marine vehicle between the collapsed position and the radar position.

In yet another alternative embodiment, as seen in FIG. 38, the top 10 could include the rear actuator 42 having a first end pivotally attached to the main bow 16 and a second end pivotally attached to the rear strut 26 and the forward actuator 44 with a first end pivotally attached to the first portion 30A of the forward strut and a second end pivotally attached to the main bow 16 described in above with respect to FIGS. 36 and 37, respectively.

Similar to the embodiment discussed above in which a mounting bracket 18, rear strut 26, forward strut 30, rear brace 34, forward brace 36 are located on each side of the top, a rear actuator, for example a port rear actuator and starboard rear actuator and a forward actuator, for example a port forward actuator and starboard forward actuator could be used on each side of the top. When the port aft strut and starboard aft strut are in the first aft position and the port forward strut and the starboard forward strut are in the first forward position, the aft bow and forward bow will be in the raised position. And, when the port aft strut and starboard aft strut are in the second aft position and the port forward strut and the starboard forward strut are in the second forward position, the aft bow and forward bow will be in the stowed position. And, when the port aft strut and starboard aft strut are in the second aft position and the port forward strut and starboard forward strut are in the first forward position, the aft bow and the forward bow will be in the radar position.

While the top 10 in some embodiments is shown positioned towards the rear of the vehicle, it is understood by those skilled in the art that the position of the top could be moved anywhere between the front and the rear of the vehicle. Further, while the top 10 in some embodiments shown with the secondary frame is towards the front of the vehicle, it is understood by those skilled in the art that the top could be rotated 180 degrees. The orientation and placement of the top 10 relative to the vehicle can be adjusted due to the layout and purpose, size and configuration of the vehicle.

Figure 14:
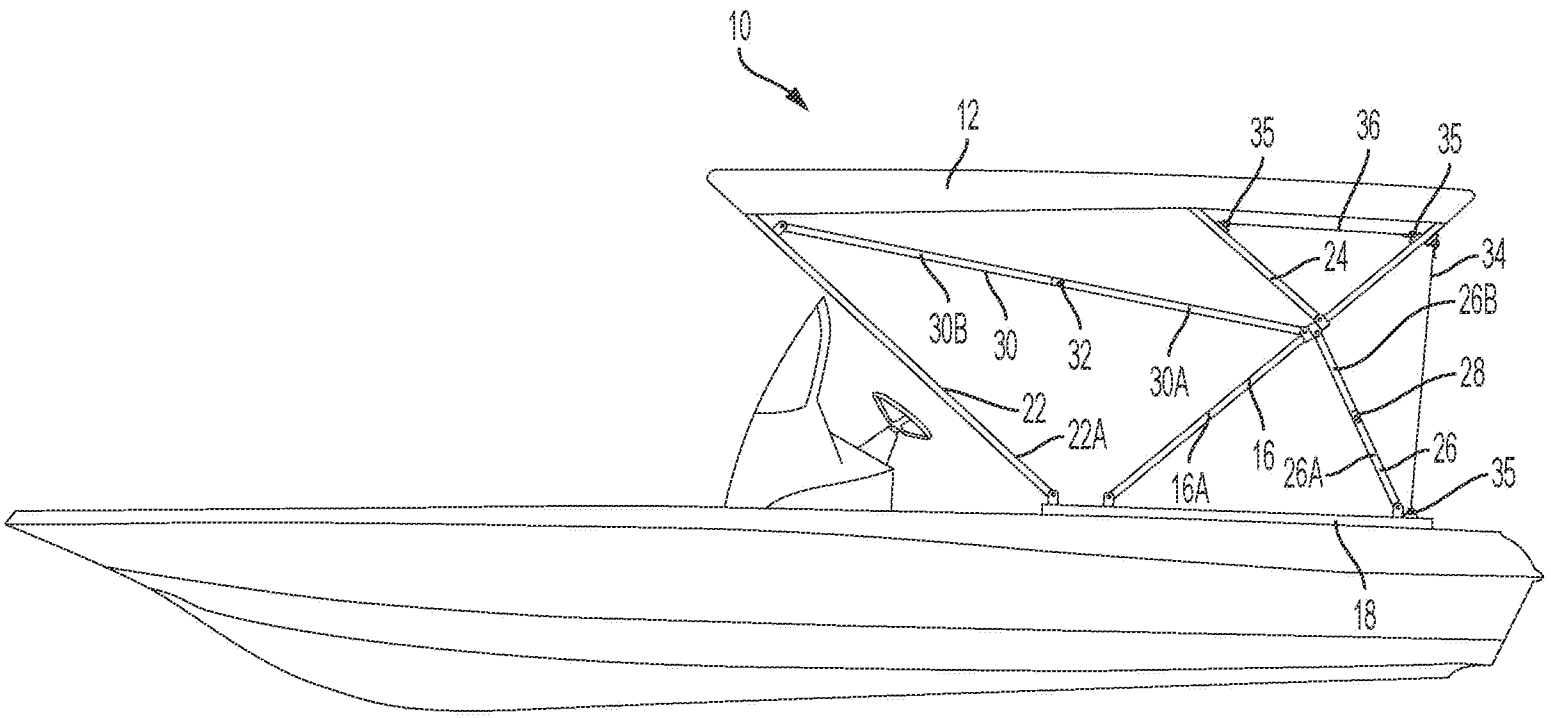
FIG. 14 is a side elevational view of one embodiment of a top attached to another type of marine vehicle.

Although the invention has been herein described in what is perceived to be the most practical and preferred embodiments, it is to be understood that the invention is not intended to be limited to the specific embodiments set forth above. For example, although the support member is described as being used in a frame for a marine top, the support member could be used in a variety of applications including a pontoon boat (FIG. 3A), V-hull boat (FIG. 14) or even other collapsible structures. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein. Further, although certain advantages of different embodiments and disadvantages of certain prior art are described, no single claim must realize every or any benefit or overcome every or any disadvantage.

What is claimed is:

1. A top comprising:

a frame further comprising:

a mounting bracket configured to attach the top to a structure;

a main frame member attached to the mounting bracket;

a secondary frame member attached to the main frame member;

a rear strut attached to the main frame member;

an actuator attached to the frame; and a covering attached to the main frame member and the secondary frame member;

wherein, the actuator is configured to move between a first position and a second position;

wherein when the actuator is in the first position, the frame is in at least a partially raised position; and wherein when the actuator is in the second position, the frame is in a collapsed position.

2. The top of claim 1, wherein the actuator is a first actuator, and the frame further comprises:

a second actuator attached to the frame;

wherein, the second actuator is configured to move the frame between the at least partially raised position and a deployed position.

3. The top of claim 2, wherein the top is configured to be moved between a first position and a second position;

wherein the rear strut can be moved between a retracted position and an extended position;

wherein when the rear strut is in the extended position, the top is in the first position; and wherein when the rear strut is in the retracted position, the top is in the second position.

4. The top of claim 3, wherein when the top is in the first position, the covering is expanded; and wherein when the top is in the second position the covering is contracted.

5. The top of claim 4, further comprising an auxiliary frame member attached to the covering;

wherein the covering is configured such that when the top is moved towards the first position, a portion of the covering between the secondary frame member and the auxiliary frame member will become taught and as the top is moved further towards the first position, the auxiliary frame member will be pulled by the portion of the covering from a collapsed position to an expanded position.

6. The top of claim 3, wherein the top is configured to be moved between the first position, an intermediate position and the second position; wherein the rear strut can be moved to a partially extended position; and wherein when the rear strut is in the partially extended position, the top is in the intermediate position.

7. The top of claim 2, wherein the first actuator is configured to move the rear strut between the retracted position, the partially extended position, and the extended position.

* * * * *